US006796908B2

(12) United States Patent
Weston

(10) Patent No.: US 6,796,908 B2
(45) Date of Patent: Sep. 28, 2004

(54) INTERACTIVE DARK RIDE

(75) Inventor: Denise Chapman Weston, Wakefield, RI (US)

(73) Assignee: Creative Kingdoms, LLC, Wakefield, RI (US)

( * ) Notice: Subject to any disclaimer, the term of this patent is extended or adjusted under 35 U.S.C. 154(b) by 0 days.

(21) Appl. No.: 10/172,786

(22) Filed: Jun. 14, 2002

(65) Prior Publication Data

US 2003/0106455 A1 Jun. 12, 2003

Related U.S. Application Data

(60) Provisional application No. 60/298,671, filed on Jun. 14, 2001, now abandoned.

(51) Int. Cl.[7] ..... A63G 1/34

(52) U.S. Cl. ..... 472/43; 472/60; 472/130; 434/55

(58) Field of Search ..... 472/40, 41, 43, 472/59, 60, 61, 62, 64, 74, 130; 434/29, 55

(56) References Cited

U.S. PATENT DOCUMENTS 973,105 A * 10/1910 Chamberlain, Jr. ..... 104/64
1,218,200 A 3/1917 Maynes
1,652,975 A * 12/1927 Davidson ..... 472/38
1,789,680 A 1/1931 Gwinnett
3,468,533 A * 9/1969 House, Jr. ..... 472/60
3,949,679 A 4/1976 Barber
5,127,657 A 7/1992 Ikezawa et al.
5,382,026 A 1/1995 Harvard et al.
5,403,238 A 4/1995 Baxter et al.
5,453,053 A 9/1995 Danta et al.
5,482,510 A * 1/1996 Ishii et al. ..... 472/61
5,509,806 A 4/1996 Ellsworth
5,533,933 A 7/1996 Garnjost et al.
5,623,878 A 4/1997 Baxter et al.
5,685,776 A * 11/1997 Stambolic et al. ..... 463/46
5,716,281 A 2/1998 Dote
5,785,592 A * 7/1998 Jacobsen ..... 463/7
5,906,542 A 5/1999 Neumann
5,911,634 A 6/1999 Nidata et al.
5,931,739 A 8/1999 Layer et al.
6,024,647 A 2/2000 Bennett et al.
6,060,847 A 5/2000 Hettema et al.
6,079,982 A * 6/2000 Meader ..... 434/29
6,095,926 A 8/2000 Hettema et al.
6,220,171 B1 4/2001 Hettema et al.
6,220,965 B1 4/2001 Hanna et al.
6,224,491 B1 * 5/2001 Hiromi et al. ..... 472/59
6,371,853 B1 4/2002 Borta
6,445,960 B1 9/2002 Borta
6,462,769 B1 * 10/2002 Trowbridge et al. ..... 348/51
6,463,859 B1 10/2002 Ikezawa et al.

* cited by examiner

*Primary Examiner*—Kien Nguyen
(74) *Attorney, Agent, or Firm*—Jonathan A. Barney

(57) ABSTRACT

The invention provides an interactive dark ride configured and designed to stimulate the development of creative thinking and problem solving abilities and to encourage group cooperation and team work. A dark ride vehicle is also provided having inward-facing seating adapted to facilitate socializing and group gaming activities among ride participants during the ride sequence. Various interactive effects are provided along a defined ride path and/or along various associated ride cueing areas. The interactive effects are configured and arranged such that ride participants selectively actuate the various effects by successfully completing various requested tasks. Some or all of the interactive effects require the cooperation of multiple ride participants (either on the same vehicle, other vehicles and/or in adjacent queuing areas) in order to actuate the desired effect(s).

31 Claims, 11 Drawing Sheets

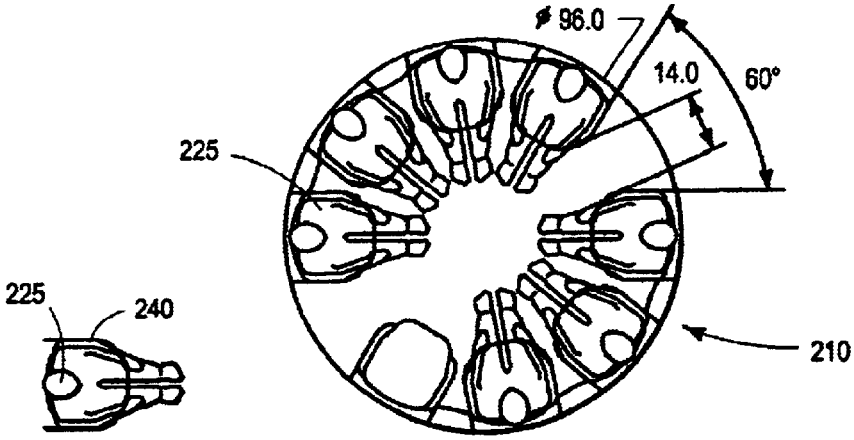
FIG. 6G
FIG. 6B
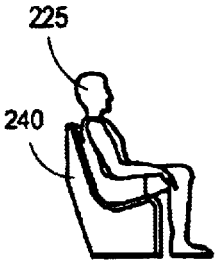
FIG. 6F
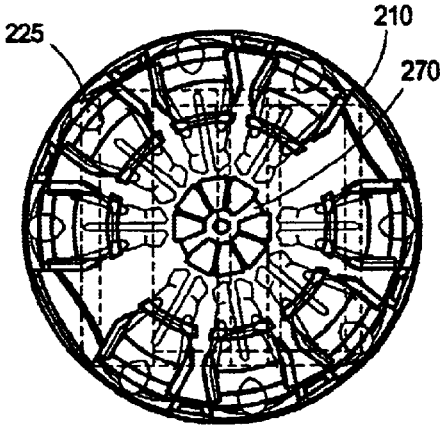
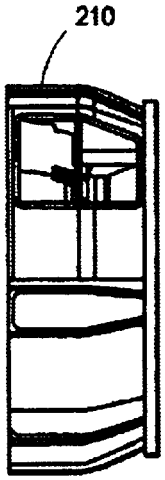
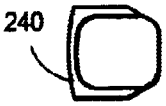
FIG. 6E
FIG. 6A
FIG. 6C
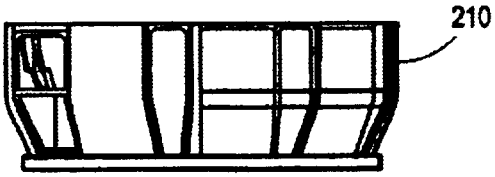
FIG. 6D

INTERACTIVE DARK RIDE

RELATED APPLICATIONS

This application claims priority under 35 U.S.C. 119(e) to U.S. provisional application Ser. No. 60/298,671 filed Jun. 14, 2001 now abandoned.

BACKGROUND OF THE INVENTION

1. Field of the Invention

This invention relates in general to amusement park rides typically known as "dark rides" and, in particular to a new class of dark rides having interactive gaming features and a novel dark ride vehicle having inward-facing seating.

2. Description of the Related Art

Amusement parks often have one or more "dark rides" in which people are seated in a ride vehicle that travels along a predetermined track or channel. The track or channel usually follows a twisting, turning, labyrinthine pathway that is designed to carry the riders through various rooms and/or past various fixed and/or animated displays or other visual, aural or tactile effects. A typical dark ride may transport rider(s) through a light-controlled region intended to simulate, for example, a tunnel, the inside of a cave or mountain, a haunted house, or some other real or imaginary environment. The intent is generally to give riders the impression of being transported through a particular desired fantasy world or other simulated environment. See, e.g., U.S. Pat. Nos. 6,220,171 and 3,949,679, incorporated herein by reference.

Conventional dark rides are typically "passive" in nature—that is, the various displays and effects are intended only to be observed by ride participants. While such rides can be entertaining, they do not generally stimulate the development of creative thinking or problem solving abilities. It is preferred to provide a ride environment that is "active" or "interactive" and which allows and encourages ride participants to operate and control any one of a number of interactive effects while observing and learning about the associated causes and effects.

Conventional dark rides also typically provide generally forward-facing bench-style seating designed to orient and focus riders' attention on the various effects occurring outside the ride vehicle and along the ride path. As a result, enjoyment of the dark ride and the various effects is largely an individual or "introverted" experience. However, it is preferred to provide a ride experience that is social or "extroverted" such that the experience may be shared and simultaneously enjoyed with other riders in the ride vehicle.

SUMMARY OF THE INVENTION

The present invention expands and improves upon the concept of a dark ride by providing a fun and entertaining interactive ride experience that not only stimulates the development of creative thinking and problem solving abilities, but which does so in a way that fosters and encourages group cooperation and team work to achieve a common defined goal. A novel dark ride vehicle is also provided having inward-facing seating adapted to facilitate socializing and group gaming activities among ride participants.

In one embodiment, the present invention provides a dark ride in which various interactive effects are provided along a defined ride path and/or along various associated ride cueing areas. The interactive effects are configured and arranged such that ride participants selectively actuate the various effects by successfully completing various requested tasks. Optionally, the interactive effects may require the cooperation of multiple ride participants (either on the same vehicle, other vehicles and/or in adjacent queuing areas) in order to actuate the desired effect(s).

In accordance with another embodiment, the present invention provides an interactive ride vehicle having thereon various controls, buttons and/or other actuator devices and which operably communicate with various interactive effects placed along the ride vehicle path. The interactive ride vehicle preferably has simulated intelligence, verbal interactivity or an electronic personality. Each ride vehicle may have a different personality or "life force" associated therewith which provides interactivity, entertainment and/or various gaming experiences during the ride experience. Such "smart" ride vehicles may be adapted and configured to verbally, physically and/or visually interact with riders, other ride vehicles and/or with various interactive effects arranged along the ride path.

In accordance with another embodiment, the present invention provides a dark ride vehicle having an inward-facing seating configuration adapted to facilitate socializing and cooperative gaming activities among ride participants. This may be a round, rotationally symmetric vehicle having anywhere from 2 to 12 seats thereon all facing the center of the vehicle so that ride participants may observe each other during the ride experience. Optionally, various interactive effects may be provided on the ride vehicle and which may be actuated by one or more of the ride participants thereon. These ride-vehicle interactive effects may assist in actuating or may themselves interact and/or actuate other interactive effects arranged along the ride path.

In accordance with another embodiment, the present invention provides a dark ride having integrated electronic gaming effects. The gaming effects utilize an interactive "wand" and/or other tracking/actuation device to allow ride participants to electronically and "magically" interact with their surrounding play environment(s). Optionally, multiple ride participants, each provided with a suitable "wand" and/or tracking device, may play and interact together, either within or outside the ride environment, to achieve desired goals or produce desired effects within the ride environment.

In accordance with another embodiment the present invention provides an interactive ride vehicle and seemingly magical ride vehicle interface for enabling trained users to electronically send and receive information to and from other ride vehicles and/or to and from various transceivers distributed throughout the ride and/or connected to a master control system. The ride interface is configured to use a send/receive radio frequency communication protocol which provides a basic foundation for a complex, interactive entertainment system to create a seemingly magic interactive gaming experience for ride participants who possess and learn to use the magical interface. The magical interface may be embodied in an on-board integrated device and/or an extrinsic object such as a wand toy.

In accordance with another embodiment the present invention provides an interactive dark ride structure in the theme of a "magic" training center for would-be wizards in accordance with the popular characters and storylines of the children's' book series "Harry Potter" by J. K Rowling. Within the ride environment, ride participants learn to use a "magic wand" and/or other tracking/actuation device. The wand allows ride participants to electronically and "magically" interact with their surrounding environment simply by pointing or using their wands in a particular manner to achieve desired goals or produce desired effects within the play environment. Various receivers or transceivers are distributed throughout the ride structure to facilitate such interaction via known wireless communications protocols.

In accordance with another embodiment the present invention provides a wand actuator device for actuating interactive various play effects within an RFID-compatible play environment. The wand comprises an elongated hollow pipe or tube having a proximal end or handle portion and a distal end or transmitting portion. An internal cavity may be provided to receive one or more batteries to power optional lighting, laser or sound effects and/or to power long-range transmissions such as via an infrared LED transmitter device or RF transmitter device. The distal end of the wand is fitted with an RFID (radio frequency identification device) transponder that is operable to provide relatively short-range RF communications (<60 cm) with one or more receivers or transceivers distributed throughout a play environment. The handle portion of the wand is fitted with optional combination wheels having various symbols and/or images thereon which may be rotated to produce a desired pattern of symbols required to operate the wand or achieve one or more special effects.

In accordance with another embodiment the present invention provides an RFID card or badge intended to be affixed or adhered to the front of a shirt or blouse worn by a ride participant while visiting an RF equipped interactive ride facility. The badge comprises a paper, cardboard or plastic substrate having a front side and a back side. The front side may be imprinted with graphics, photos, or any other information desired. The front side may include any number of other designs or information pertinent to its application. The obverse side of the badge contains certain electronics comprising a radio frequency tag preprogrammed with a unique person identifier number ("UPIN"). The UPIN may be used to identify and track individual ride participants within the play facility. Optionally, each tag may also include a unique group identifier number ("UGIN") which may be used to match a defined group of individuals having a predetermined relationship.

In accordance with another embodiment the present invention provides an electronic role-play ride utilizing specially configured electronically readable character cards. Each card is configured with an RFID or a magnetic "swipe" strip, alpha-numeric encoding and/or the like, that may be used to store certain information describing the powers or abilities of an imaginary role-play character that the card represents. As each play participant uses his or her favorite character card in various ride facilities the character represented by the card gains (or loses) certain attributes, such as magic skill level, magic strength, flight ability, various spell-casting abilities, etc. All of this information is preferably stored on the card so that the character attributes may be easily and conveniently transported to other similarly-equipped ride facilities, computer games, video games, home game consoles, hand-held game units, and the like. In this manner, an imaginary role-play character is created and stored on a card that is able to seamlessly transcend from one play medium to the next.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention and its essential features and advantages, certain preferred embodiments and modifications thereof will become apparent to those skilled in the art from the detailed description herein having reference to the figures that follow, of which:

FIG. 6A is a top plan view of the interactive dark ride vehicle of FIG. 5;

FIG. 6B is a schematic seating plan for the interactive dark ride vehicle of FIG. 5;

FIG. 6C is a side elevation view of the interactive dark ride vehicle of FIG. 5;

FIG. 6D is a from elevation view of the interactive dark ride vehicle of FIG. 5;

FIG. 6E is a detail view of a seat module comprising part of the interactive dark ride vehicle of FIG. 5;

FIG. 6F is a side elevation view of the seat module of FIG. 6E with a seated ride participant therein;

FIG. 6G is top plan view of the seat module of FIG. 6E with a seated ride participant therein;

DETAILED DESCRIPTION OF THE PREFERRED EMBODIMENTS

Figure 1:
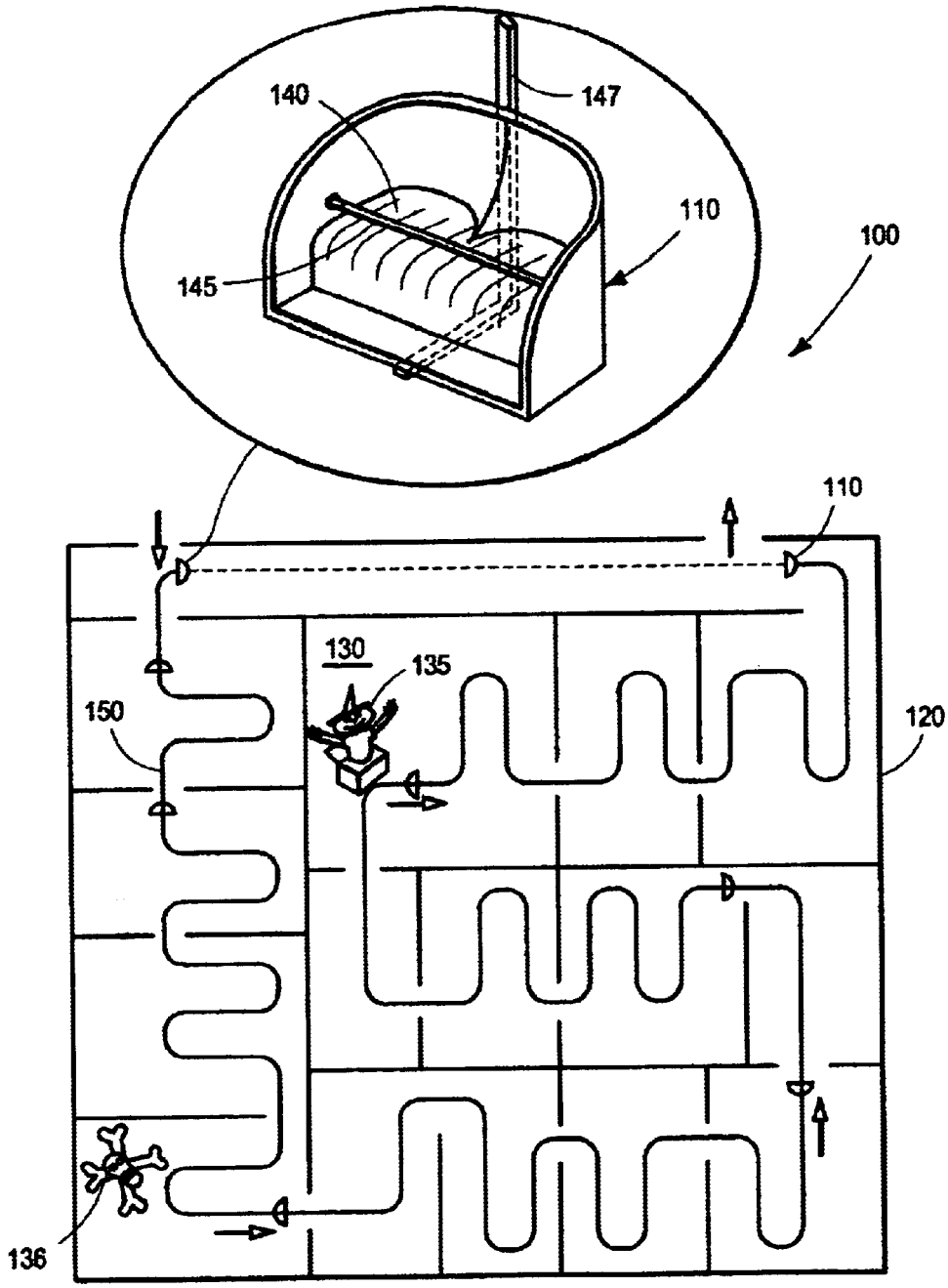
FIG. 1 is a schematic plan view depicting a typical layout of an amusement park dark ride and dark ride vehicle constructed in accordance with the current state of the art.

In describing the various preferred embodiments in reference to the appended figures, similar reference numerals may sometimes be used to indicate similar structures or features of the invention. However, it is to be understood that such indicated structures or features may or may not be identical in the various described embodiments of the invention.

FIG. 1 is a top plan schematic view depicting a typical layout of an amusement park "dark ride" 100 and dark ride vehicle 110 constructed in accordance with the current state of the art. The ride 100 generally comprises a themed ride enclosure or housing 120 that is divided into multiple rooms or cells 130. Each cell contains various visual, aural and/or tactile effects (e.g., a surprise jack-in-the-box 135, or a scary skull-and-cross-bones display 136. These effects are normally thematically arranged and operated to be observed by riders (not shown) as they enter and pass through each of the various rooms 130.

The vehicle 110 is designed to travel along a predetermined track or channel 150 (an overhead track in the illustrated example), which guides the vehicle 110 along a generally twisting, turning, labyrinthine pathway through the various rooms 130. The vehicle 110 is typically equipped with wheels, runners and/or other suitable engagement means (a suspension arm 147 in the illustrated example) for securing the vehicle to the track 150. The track guides the vehicle 110 and carries the riders through the various rooms 130 and past various fixed and/or animated displays or other visual, aural or tactile effects. For example, a typical dark ride may transport rider(s) through a light-controlled enclosure 120 intended to simulate a tunnel, the inside of a cave or mountain, a haunted house, or some other real or imaginary environment. The intent is generally to give riders the impression of being transported through a particular desired fantasy world or simulated environment. See, e.g., U.S. Pat. No. 6,220,171 to Hettema, et al, and U.S. Pat. No. 3,949,679 to Barber.

In operation, two or more ride patrons are seated on a bench-like seat 140 provided within the ride vehicle 110, as illustrated. The ride patrons are normally restrained by a safety-bar 145. The seats are generally fixed and forward/outward facing so that riders may observe the various visual effects revealed as the ride vehicle traverses throughout the themed enclosure 120. In some dark rides, the vehicle may also be turned or rotated at certain points during the ride sequence in order to help orient and focus riders' attention on various selected effects occurring outside the ride vehicle 110 along the ride path.

Interactive Effects

The present invention provides a new class of interactive dark rides 200 in which various interactive effects 235, 236, 237 are provided along the ride path and/or along various associated ride cueing areas. These effects are preferably arranged and configured so that they may be enjoyed and operated by ride patrons during the course of their ride experience. Optionally, some or all of the interactive effects may be arranged and configured so as to be operated by ride participants either before, during, and/or after riding the ride. The interactive effects are preferably configured and arranged such that ride participants can selectively actuate the various effects by successfully operating a console/control 270 and/or by completing various requested tasks. Optionally, the interactive effects may require the cooperation of multiple ride participants (either on the same vehicle, other vehicles and/or in adjacent queuing areas) in order to actuate the desired effect(s). Thus, a ride environment is provided that is "active" or "interactive" and which allows and encourages ride participants to operate and control any one of a number of interactive effects while observing and learning about the associated causes and effects. Preferably, the various effects are arranged so as to challenge the reflexes, coordination and quick decision-making skills of ride participants in a similar manner as provided by video arcade games and/or computer games. If desired, the ride 200 may be themed and configured as a physical extension of any one of a number of popular video/computer games. Thus, the invention facilitates a life size computer game being brought to life in a dark ride.

Figure 3:
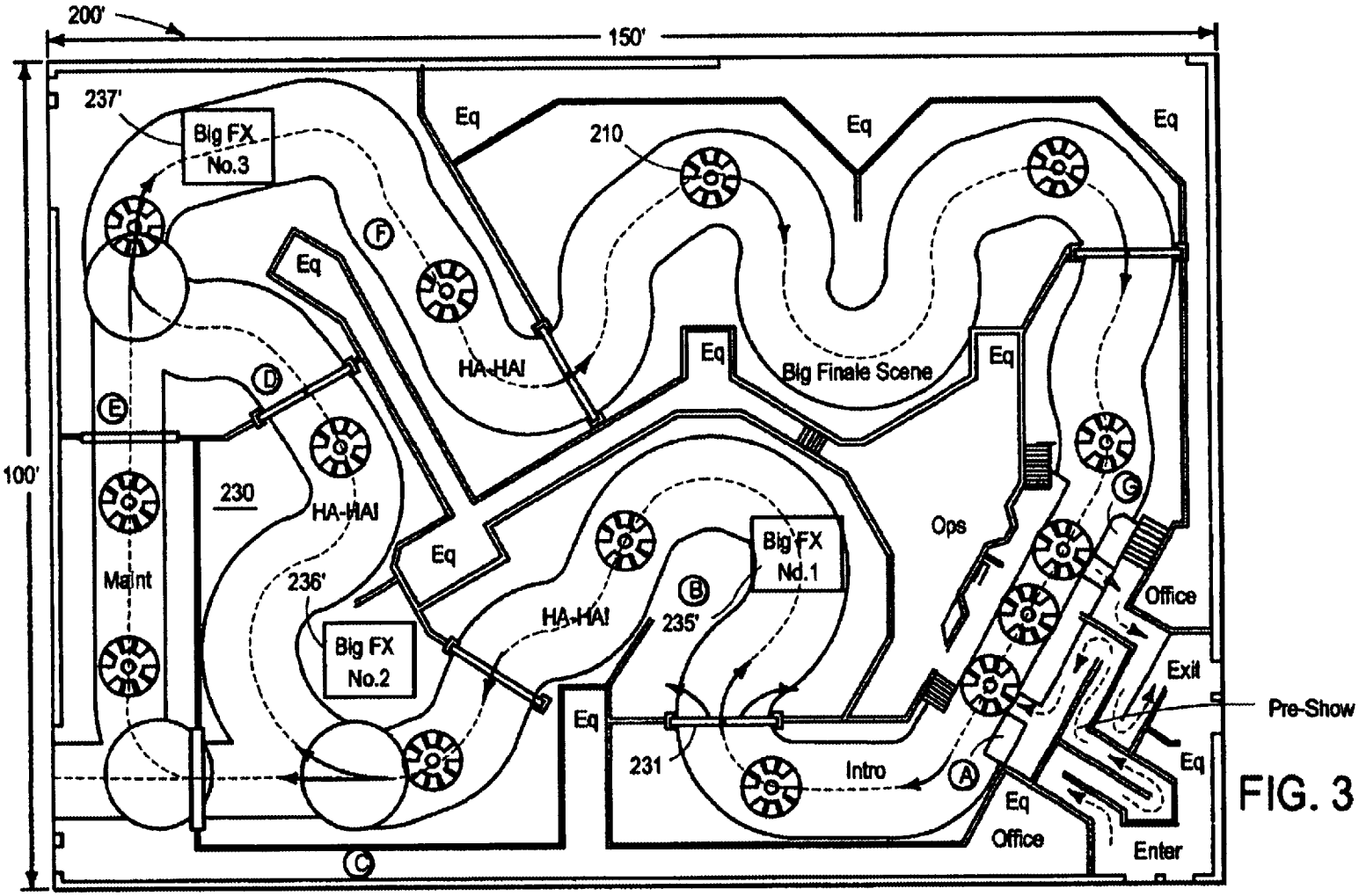
FIG. 3 is a schematic plan view of an alternative embodiment of an interactive dark ride having features and advantages of the present invention.

FIG. 3 is a plan view of an alternative embodiment of an interactive dark ride 200' having features and advantages in accordance with the present invention. In this case, ride patrons enter the ride vehicle 210 at point A. The vehicle 210 then traverses through a defined ride sequence entering and exiting various rooms 230 separated by penning and closing doors 231. Each room 230 has various themed interactive effects 235', 236', 237' therein. Along the ride, ride patrons accomplish certain interactive tasks and thereby accumulate certain points or magic "powers" for themselves and/or their vehicle. From point A to point B the game is generally introduced and riders are instructed how to play and operate their vehicles. The first interactive effect 235' takes place at point B. This may be a 3-dimisional moving graphic/visual that scares or thrills riders. Riders may be provided with appropriate 3-D glasses to view such an effect. At point C a gate or switch is selectively actuated to direct each ride vehicle along either one of two paths, depending upon the number of points or magic powers accumulated. Vehicles with low point scores are directed along a first path to point D (e.g., vehicle repair station), while vehicles with high point scores are directed along a second path to point E (e.g., celebration party). The ride vehicles then reconverge at point F where upon the vehicles complete their ride sequence and allow riders to exit at point G. In this manner, the ride experience is different for different ride patrons and, thus, riders are encouraged to repeat the ride experience in order to enjoy both (and/or multiple other) experiences. Alternatively, the second path to point E may simply be used for maintenance of vehicles and, therefore, normally be closed to riders.

Figure 4A:
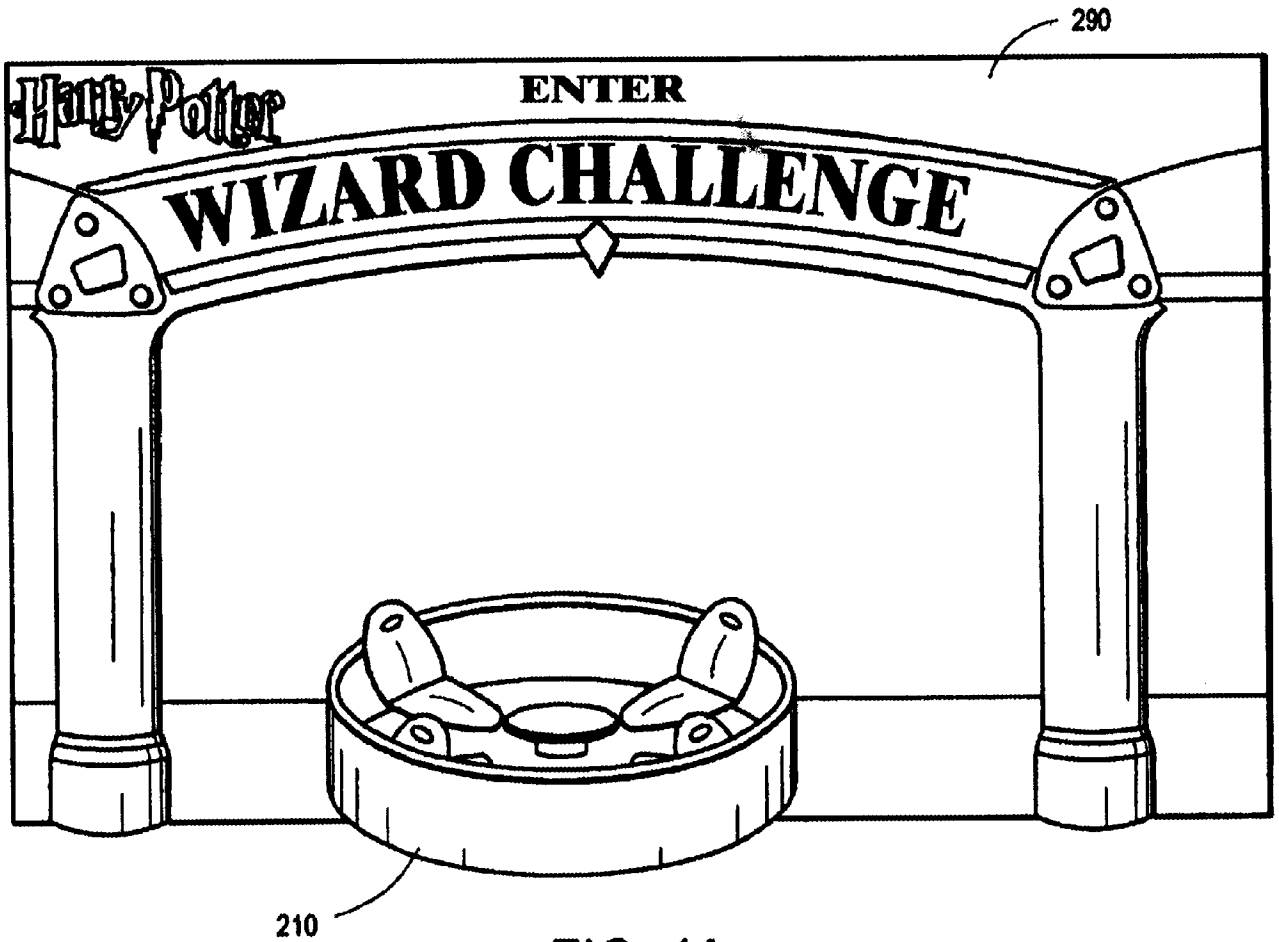
FIGS. 4A & 4B are perspective views of another embodiment of an interactive dark ride provided in the theme of a "magic" training center for would-be wizards in accordance with the popular characters and storylines of the children's' book series "Harry Potter" by J. K Rowling and having features and advantages of the present invention.
Figure 4B:
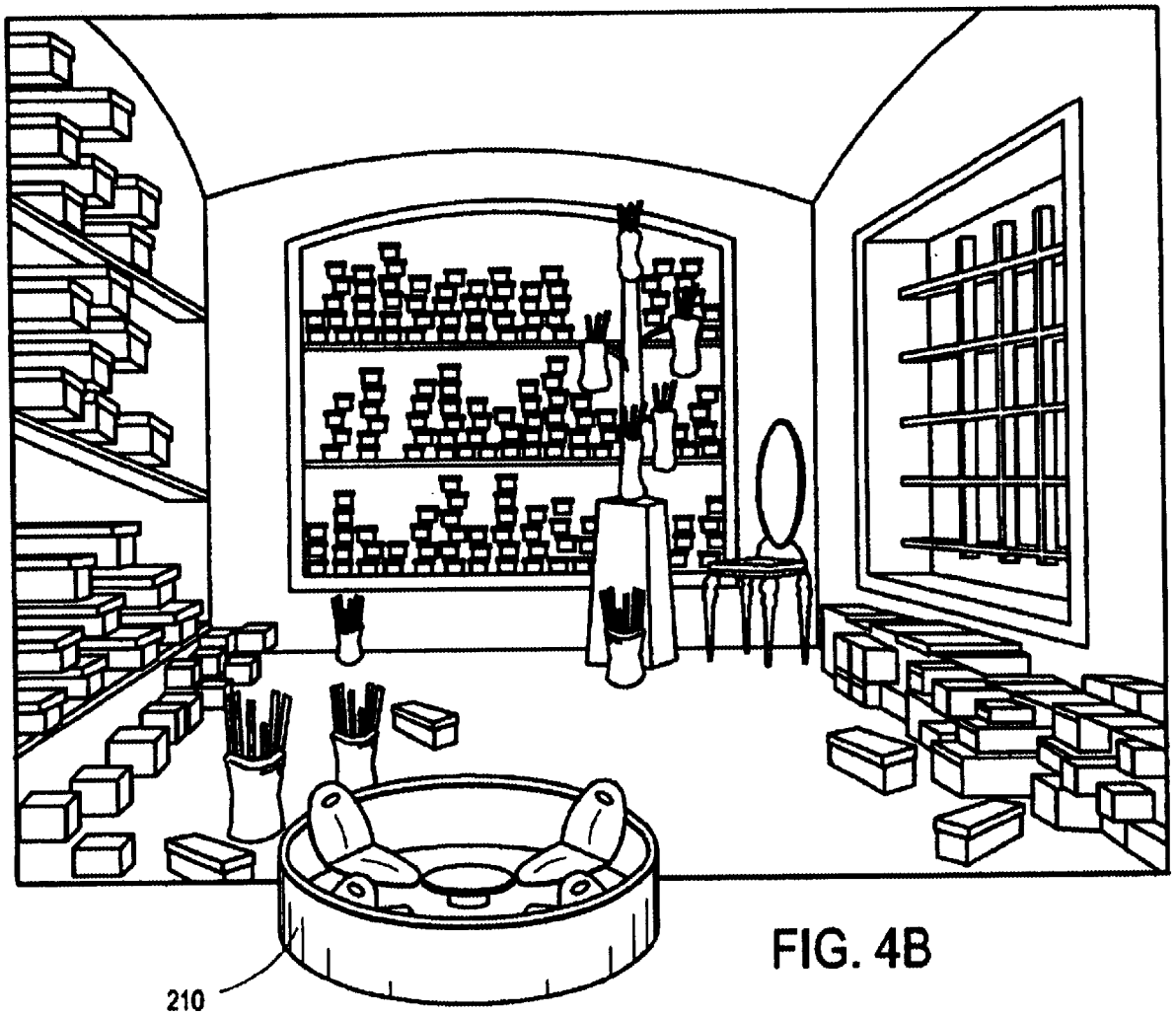

The interactive dark ride 200, 200' in accordance with the invention may be designed and configured in accordance with one of a number of different themes so as to elicit feelings and/or imagery of, for example, flying, spelunking, mountain climbing, exploring a lost temple, witchcraft training facility, and/or the like. In a particularly proffered embodiment as illustrated in more detail in FIGS. 4A & 4B, an interactive dark ride 200, 200' is provided in the theme of a "magic" training center for would-be wizards in accordance with the popular characters and storylines of the children's' book series "Harry Potter" by J. K Rowling. Thus, FIG. 4A illustrates an interactive dark ride vehicle 210 in accordance with the invention entering a Harry Potter™ wizard training center. FIG. 4B illustrates an interactive dark ride vehicle 210 in accordance with the invention entering a room 230 themed as a library from Harry Potter's Hogwarts school. In this particular room 230, for example, riders on ride vehicle 210 may be trained how to cast various magic spells, levitate books, grow and shrink objects, materialize objects from thin air, etc. These effects may be brought about by using various controls on the ride vehicle, reciting magic words or phrases, and/or by using a specially configured "magic" wand. Table 1, below, is a list of possible interactive effects that may be used in accordance with the invention and without limiting the scope thereof.

TABLE 1

| INTERACTIVE RIDE EFFECTS |
|---|
| LAUNCH |
| LAND |
| FREEZE |
| FIRE |
| EARTHQUAKE |
| LASER FIGHT |
| DRAG BEHIND (LIKE BEHIND SKI BOAT) |
| CRASH INTO WALL/PIE) |
| RUBBERBAND BOING BACK EFFECT TORNADO |
| DROP OFF HILL |
| ROLL OVER SEVERAL TIMES |
| SHRUNKEN |
| MORPH INTO SOMETHING |
| VISUAL OPTICAL TRICKS |
| HYPNOTIC WHEEL |
| PSYCHEDELIC MOIRÉ' |
| 70'S HALLUCINOGENIC EFFECTS |
| LAVA LAMP EFFECTS |
| BLAST EFFECT |
| FIRE EXPLOSION EFFECT |
| RADIATION EFFECT |
| INFINITY EFFECTS |
| FLYING THRU CLOUDS EFFECT |
| BLINDING LIGHT SEQUENCE |
| FLASH BANG SEQUENCE |
| STROBING LIGHTS |
| DANGLING ICKY THINGS |
| STROBING ANIMATIONS/SHADOWS |
| OPTICAL MIRROR DISTORTION |
| OPTICAL SCALING EFFECTS |
| DIGITAL DISTORTIONS EFFECT |
| HIGH VELOCITY WIND EFFECT |
| SPLASH EFFECT IN ELECTRICAL CHARGED AREA |
| ELECTRICAL OVERCHARGE/ELECTROCUTION |
| FLOATING DIGITAL CAPTURED HEADS |
| MORPHING DIGITAL CAPTURED HEADS |

Ride Vehicle

Figure 2:
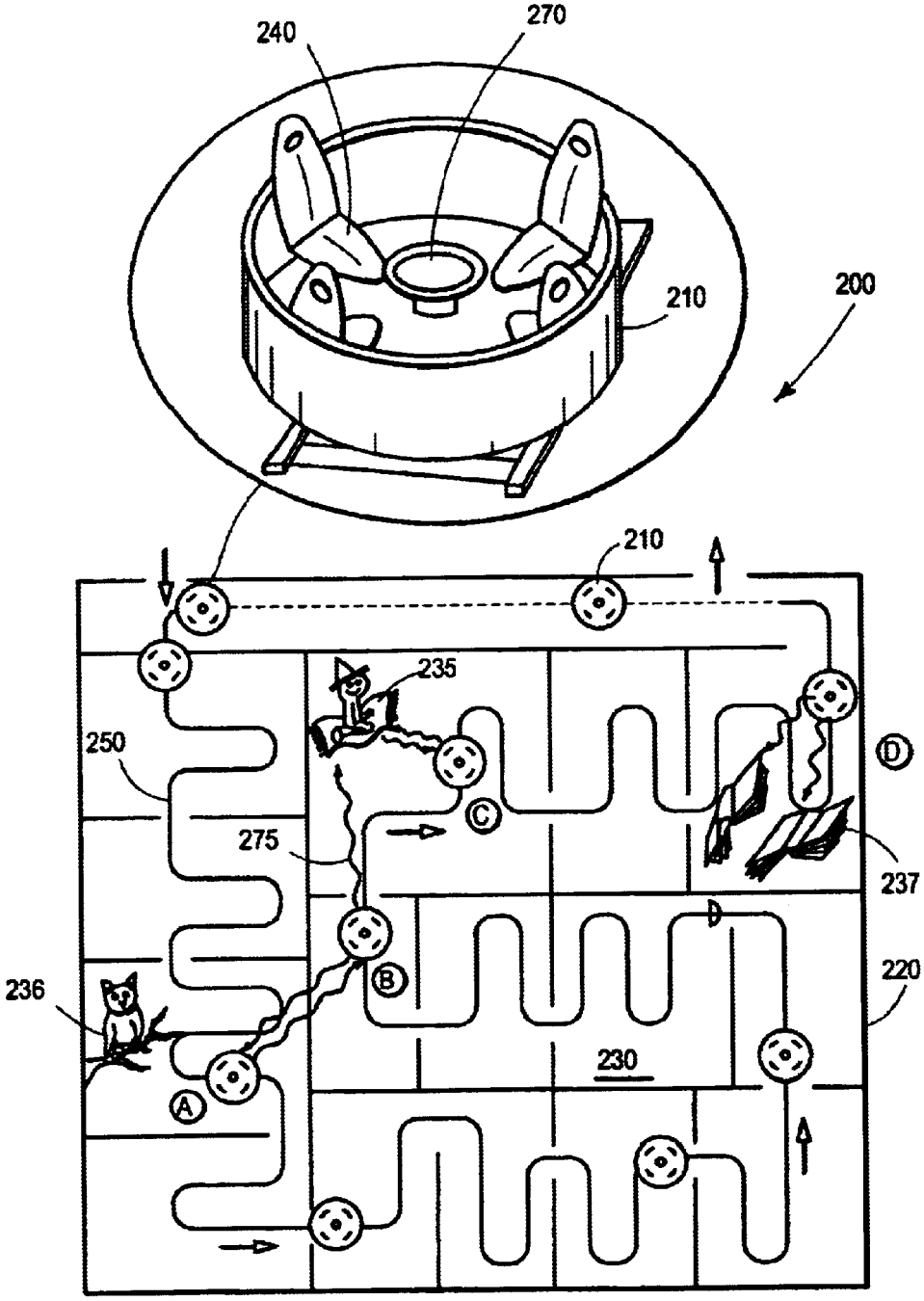
FIG. 2 is a schematic plan view of an interactive dark ride and dark ride vehicle having features and advantages of the present invention.

In the preferred embodiment illustrated, an interactive ride vehicle 210 is provided having thereon a control console 270 with various controls, buttons, display monitors, and/or other actuator or display devices. Alternatively, and/or in addition, one or more "magic" wands may be provided with each vehicle having various controls, buttons, etc. These controls, buttons and/or other devices, when appropriately actuated, operably communicate with various other interactive effects 235–237 placed along the ride vehicle path and/or with other ride vehicles. For example, FIG. 2 illustrates such communications via RF signals 275. For example, at point A riders in ride vehicle 210 press one or more buttons in a specified combination or sequence to cause an RF signal 275 to be transmitted by the vehicle 210 (or via an associated object or toy, such as a magical wand device) to interactive effect 236. Interactive effect 236 is configured and arranged to receive the RF signal 275 and to respond thereto. For example, the effect may be an owl that wakes up and speaks to riders and tells them how they can cast a special magic spell and/or access a secret passage within and/or outside the ride sequence. However, if the riders do not press the correct combination of buttons, the owl stays asleep and the riders do not learn of the secret information.

At point B riders in one vehicle 210 can interact with riders in another vehicle 210 by causing their vehicles to send RF signals (and/or other signals) to one another. For example, riders in one vehicle may be able to "cast a spell" on riders in another vehicle to cause the other vehicle to slow down, run out of gas, vibrate, develop cracks, deplete its magical powers, etc. These spell-induced vehicle conditions would then need to be attended to and remedied by the riders of the affected vehicle. Thus riders in each vehicle are able to amuse themselves by learning how to cast various spells on other vehicles and to defend against and/or backfire certain other spells, etc. Advantageously, this makes the ride experience different each time through and continuously challenges riders to become better and more proficient at the various tasks presented. It also encourages riders to come back and ride the ride multiple times in order to learn and exploit all of the various secrets revealed during the ride experience. Optionally, similar consoles or wands (not shown) may be provided for ride patrons waiting in line for the ride so that waiting patrons can also cast certain spells on ride vehicles and/or assist in various interactive effects throughout certain portions of the ride sequence. In this manner, waiting ride patrons are not bored simply waiting in line for a ride, but may start playing and participating in the ride experience even before they enter the ride vehicle.

At point C riders in another vehicle 210 can cast a spell (push the correct combination and/or sequence of buttons on console 270) to levitate a magic carpet 235. Optionally, this effect may require cooperation from other riders on other ride vehicles in order to provide enough "magical force" to levitate the carpet 235. In that case, the effect 235 would be configured and programmed to respond only if multiple RF signals 275 are received. Optionally, the effect 235 may also send an RF or other signal back to the ride vehicle 210 such that 2-way communication may be provided. At point D riders in another vehicle 210 cast a spell (push the correct combination and/or sequence of buttons on console 270) to release some flying books 237. Again, if desired, this effect may require cooperation from one or more other riders. In that case, the effect 237 could be configured and programmed to respond only if multiple RF signals 275 are received.

Preferably, signals 275 are radio frequency (RF) signals having a useable range of at least about 3–5 feet and, more preferably about 20–100 feet. Of course, those skilled in the art will recognize than any number of other suitable wireless communications mediums and protocols may be selected and used herein, such as signals transmitted and/or modulated as infrared light (IR), laser, micro-wave, UHF, VHF, ultra-sonic, magnetic, and the like. These arc discussed in more detail later.

Figure 5:
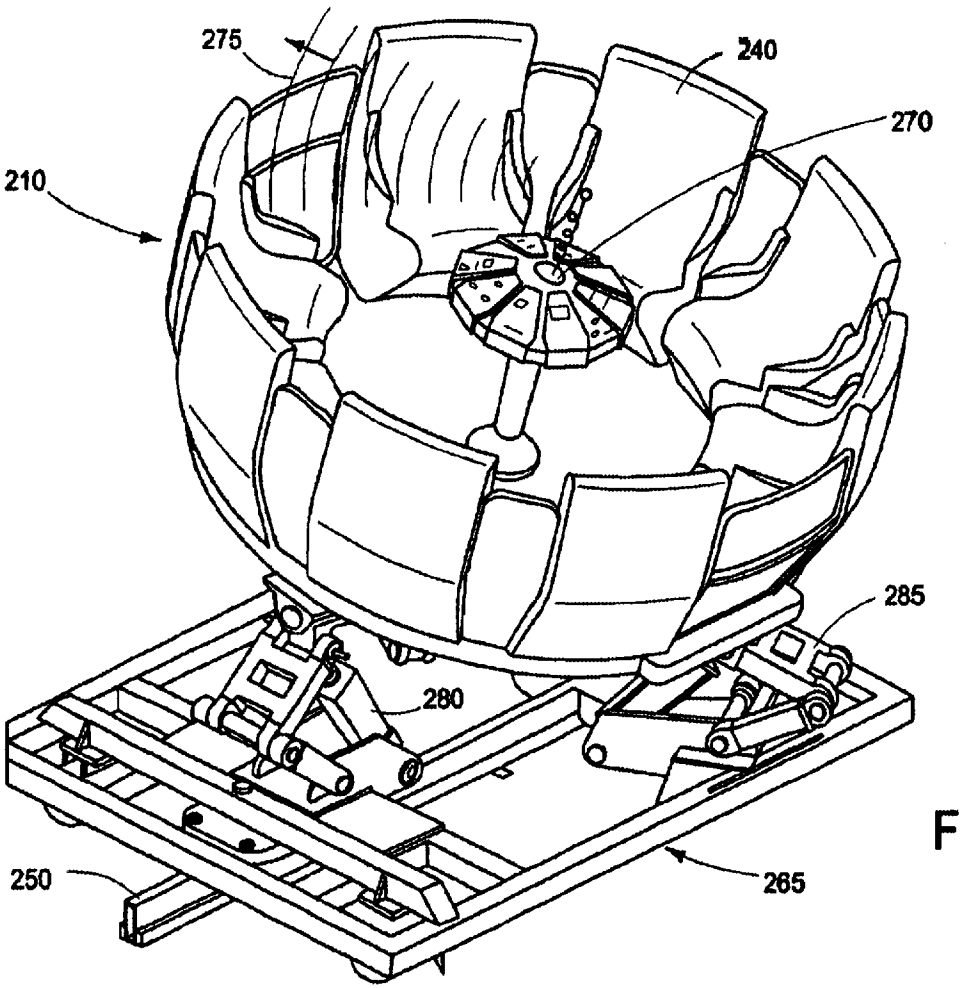
FIG. 5 is a perspective view of an alternative embodiment of an interactive dark ride vehicle having features and advantages of the present invention.

In the preferred embodiment illustrated the dark ride vehicle 210 has inward-facing seating which are adapted to facilitate socializing and cooperative gaming activities among ride participants 225 seated in circumferentially arranged seats 240 (see FIGS. 5 and 6). Thus, guests/riders face each other in essentially a round circle whereby they can see and enjoy each other's reactions and encourage interaction, eye contact, teaming and laughter between riders as they are going through the experience. If desired, the vehicle passenger compartment may also be supported on a multi-axis hydraulic platform 265 and/or other type of motion platform. For example, hydraulic actuators 280, 285 (see FIG. 5) may be used to provide numerous physical thrills and effects, such as spinning, thrusting, bouncing, shooting up and down, etc. The seats 240 within each vehicle may also have associated therewith various optional devices configured to induce certain movements or special effects (e.g., vibration). In addition, each vehicle may be outfitted with various game panels (not shown) on each seat that may be activated by the guest in playing the game.

Preferably, the vehicle 210 is round having anywhere from 2 to 12 seats thereon all facing the center of the vehicle so that ride participants may observe each other during the ride experience. Of course, other suitable shapes may be used, including triangular, square, pentagonal, hexagonal, octagonal or other regular polygon shape. Preferably, various interactive effects are provided on the ride vehicle itself e.g., via the console 270. These may be actuated by one or more of the ride participants thereon, e.g., by pushing a button, waving a magic wand or the like. These ride-vehicle interactive effects may provide entertaining visual, aural, and/or tactile sensations and/or they may assist in actuating other interactive effects arranged along the ride path. For example, one vehicle interactive effect could be a memory game in which the ride participants seated in the vehicle 210 are challenged to remember and repeat a series of musical tones corresponding to a number of lighted, colored buttons. If ride participants are successful in remembering and repeating the series, then the vehicle receives enhanced "powers" and is thereby able to actuate other effects and/or go into or experience other areas of the ride which would otherwise not be accessible. If ride participants are unsuccessful, then the vehicle may have only diminished "powers" for the remainder of the ride and, thus, be unable to access/actuate certain of the available interactive effects/areas.

Advantageously, in this manner a substantial portion of the ride entertainment focuses riders' attention towards the center of the vehicle and at each other. These ride-vehicle interactive effects can also be used to entertain ride participants in various transition times between rooms and/or other interactive effects. In this manner, the number of rooms and/or interactive effects and theming may be reduced to save costs, if desired. Alternatively, the ride could be made more compact while still enjoying a relatively high rider throughput. For example, using these concepts, a rider throughput of about 5000 riders/hour can be achieved in an interactive dark ride 200' occupying only about 15,000 square feet. This provides a high rider throughput density of about 0.33 riders per hour per square foot. A rider throughput density of between about 0.1 and 0.5 is most preferred.

Preferably, the ride vehicle 210 has simulated intelligence, verbal interactivity and/or an electronic personality. Each ride vehicle 210 may have a different personality or "life force" associated therewith which provides interactivity, entertainment and/or various gaming experiences during the ride experience. Such "smart" ride vehicles may be adapted and configured to verbally, aurally and/or visually interact with riders, other ride vehicles and/or with various interactive effects arranged along the ride path. Each vehicle has a unique and humorous personality with special effects, audio comic routines and "life panel" built into the center of the car. Thus, riders are able to participate in guiding the vehicle, repelling danger, casting spells and repairing damage as they work together in reaching their fantasy destination.

For example, each vehicle may assume the role of a character (e.g., a flying magic carpet or broomstick) in a given storyline played out in the ride 200. During the ride, each vehicle "talks" to and/or coaches its team of ride patrons and instructs them how to actuate the various interactive effects, make necessary repairs, etc. The vehicle also preferably contains a database of selected humorous sound effects, words and/or phrases which the vehicle would be programmed to broadcast during certain segments of the ride, such as when certain events happen, tasks are achieved and/or randomly. For example, when the ride vehicle goes down a chute, the vehicle could exclaim, "WEEEEE, let's do that again!" When the vehicle enters a cold area, it might shiver and/or sneeze (e.g., via hydraulic actuators 280, 285). When an undesirable effect is about to happen the ride vehicle might instruct the riders "DUCK! Or you'll get all wet!" Or it could instruct the riders, "Push the red and green buttons to defeat the dragon!" If the riders are able to take the appropriate actions within the required time, then the effect is modified (e.g., the dragon does not shoot water at the riders) and the vehicle responds accordingly (e.g., "WHEW, that was close!"). Such interactivity and simulated intelligence may easily be carried out, for example, using an on-board computer to drive the vehicle interactive effects and voice functions in conjunction with an RF transmitter/receiver for communicating necessary information with various associated interactive effects along the ride path. Certain preferred effects are listed in Tables 2–6 below:

TABLE 2

| GENERAL EFFECTS | |
|---|---|
| MOTION BASE | SCENT |
| VIBRATION | HOT/COLD |
| AIR BLAST | WATER SPRITZ |
| LIGHTS | SOUND |
| FOG | SHAKE |
| TICKLER | |

TABLE 3

| SEAT EFFECTS | |
|---|---|
| STATIC ELECTRICAL HAIR | SNEEZE EFFECTS |
| SPARKS | CRYING SPRITZ EFFECT |
| TINGLER | RUNNING SNOT EFFECT |
| SQUEEZE | OOZING GOO EFFECT |
| SHOCK | SLIMING EFFECT |
| PULSING | SUCKING EFFECT |
| HEAVING | ROMANTIC KISS EFFECT |
| CHECK MY PULSE | CONGRATULATORY KISS EFFECT |
| VOICE CHANGE MODULATOR | WET YOUR SEAT EFFECT |
| NOISE CANCELLATION | WHISPERED BREATH IN EAR EFFECT |
| POKING | COLD FINGER BRUSHING NECK EFFECT |
| STINGING | CHILLED AIR ON NECK EFFECT |
| SPOOK COLD CHILL EFFECT | THUNDER SEAT EFFECTS |
| FLASH CHILL EFFECT | TAPPING ON BACK EFFECT |
| CRAWLING BUGS | THINGS FLYING PAST EFFECT |
| WET DRIP EFFECTS | |
| SPITTING EFFECT | |
| DROOL EFFECTS | |

TABLE 4

| VEHICLE EFFECTS | |
|---|---|
| SONIC BLAST EFFECT | MINOR CRASH AND BUMP EFFECT |
| POWER BOAST | BLOWN GASKET EFFECT |
| CAST MAGIC | BLAST DAMAGE EFFECT |
| POWER SHIELD UP/DOWN | FLAMING DEATH EFFECT |
| TUNE UP/REPAIR | FLOATING EFFECT |
| BRAKES | WHITEWATER EFFECT |
| WINDOW WIPERS | SINKING EFFECT |
| BLASTER | WHIRLPOOL EFFECT |
| BURNING ENGINE EFFECT | FLATULENCE PROPULSION |
| ANGRY FUMING EFFECT | BURPING PROPULSION |
| LAUGHING/CRYING EFFECT | RAZZBERRY PROPULSION |
| SINGING EFFECT | GASPING FOR AIR EFFECT |
| SHOCK BLAST SELF | STUCK ON FLY PAPER EFFECT |
| CLEANING SEQUENCE. | STUCK IN MUD EFFECT |
| AUTOMATED SELF | VEHICLE LIFTED EFFECT |
| CLEANING SEQUENCE | VEHICLE DROPPED EFFECT |
| ANIMATED EXPRESSIONS | BLACK HOLE RIDE EFFECT |
| HIGH FIVE EFFECT | INTER-DIMENSIONAL TRANSPORT |
| GIVE ME MOUTH | EFFECT |
| TO MOUTH | VEHICLE POSSESSED EFFECT |
| GONNA MISS YOU EFFECT | SMOG CHECK BARRIER |
| OUT OF CONTROL EFFECT | BUG SHIELD EFFECT |
| HYSTERICAL EFFECT | ROAD KILL EFFECTS |
| MOODY EFFECT | GUMMY THINGS EFFECT |
| GRUMPY EFFECT | IMP SHOCKWAVE EFFECT |
| SHY EFFECT | LAUGHING EFFECT |
| LOVING EFFECT | SNICKER WITH SNOT EFFECT |
| DANCE EFFECT | COUGHING EFFECT |
| JUSTICE EFFECT | SCARED AND TREMBLING EFFECT |
| EXPLORING EFFECT | HUNGRY/GROWL EFFECT |
| PANICKING EFFECT | WHISTLE EFFECT |
| LOST EFFECT | JUMP ROPE EFFECT |
| ANGER EFFECT | TICKLE YOU/TICKLE ME EFFECT |
| CONFUSED EFFECT | CLAP/CHEER EFFECT |
| DYSLEXIC EFFECT | GOOSE YOU EFFECT |
| TRAVELING GHOST | SCRATCH MY ITCH |
| VOICE EFFECT | MASSAGE ME |
| NAILS ON CHALKBOARD | BURP ME |
| EFFECT | PET ME |
| FOG INFUSION BLAST | WAVE GOODBYE/BLOW KISSES |
| EFFECT | SMILE PRETTY |
| MAGNETIC PERIL EFFECT | |
| OIL SKID EFFECT | |
| FLAT TIRE EFFECT | |
| REINFLATING TIRE EFFECT | |
| RADICAL SKID/TURN | |
| EFFECT | |

TABLE 5

| CONSOLE EFFECTS |
|---|
| MAIN PANEL: |
| TIME COUNT |
| FUEL BAR |
| SPOT LIGHT |
| LIFE FORCE |
| DAMAGE BAR |
| MAGIC BAR |
| SHIELD ON/OFF |
| VOICE PULSE |
| IMAGING: |
| HOLOGRAPHIC ANIMATIONS |
| TALKING HEAD CENTERPIECE |
| HOLOGRAPHIC CENTERPIECE |
| SENSOR CHIP INTERACTION |
| THEMED SENSOR CHIP HOLDER |
| RECORDS INTERACTIONS |
| RECORDS INDIA. POINTS/PRIZES |
| RECORDS GROUP POINTS/PRIZES |
| RECORDS EXPERIENCE |
| RECORDS RIDE CHARACTERS |

TABLE 5-continued

| CONSOLE EFFECTS |
|---|
| RECORDS NEW RIDE |
| EXPERIENCES |
| (VEHICLE CAN TALK ABOUT |
| THEM) |
| HIGH IMPACT RESISTANT TOUCH |
| SCREENS |
| PARABOLIC DIGITAL CAPTURED |
| HEADS/GUESTS |
| ROBBY ROBOT TALKING LIGHT |
| PANELS |

TABLE 6

| GAMES |
|---|
| DUCK GOOSE GAME |
| MONKEY IN THE MIDDLE, |
| GET THEM TO SING EFFECT |
| GET THEM TO LEAN TO ONE SLIDE EFFECT |
| SONG FUSION GAME |
| JAZZ ENSEMBLE GAME |
| BLIND LEADING THE BLIND GAME |
| GAME SHOW TELL GAME |
| ANSWER THE QUESTION TO PASS GAME |
| SELECT DIALOGUE/EFFECT INTERACTION GAME |
| SIMON SUEZ LIGHT SEQUENCING GAME |
| CHASE THE FLASHING LIGHTS GAME |
| FUSION POWER GENERATOR GAME |
| LEFT BRAIN/RIGHT BRAIN GAME |
| SPLIT PERSONALITY VEHICLE |
| OUT OF CONTROL EFFECT/GAME |
| LOST MEMORY VEHICLE/REPROGRAM GAME |
| SPEED QUIZ CONFLICT GAME MULTIPLE ATTACK |
| CHOICE GAME |
| STEERING GAME |
| VELOCITY SPIN GAME |
| CASTING MAGIC SPELL GAME |
| CONSTRUCTING SILLY SENTENCES GAME |
| HANGMAN'S NOOSE GAME |
| VEHICLE DIAGNOSTICS GAME |
| SCRABBLE GAME |
| BOGGLE GAME |
| SLOT MACHINE GAME |
| DECIPHER THE CODE GAME |
| DIRECTION BY WIN GAME |
| LOVE ME/LOVE ME NOT GAME |
| MAGIC SPARKLING SPELL EFFECT |
| WIN POINTS GAME |
| OBSTACLE COURSE GAME |
| KARAOKE GAME |
| SHOUTING METER GAME |
| VOICE RECOGNITION GAME |
| PICKING COUNTRY SONG PHRASES |
| WHO WANTS TO BE A SURVIVOR GAME |
| GROUP MAJORITY GAME |
| POWER CHARGE UP GAME |

Magic Console/Wand

As indicated above, ride participants 225 within the interactive ride 200, 200' preferably learn to use a "magical" interactive console 270. For example, FIG. 5 illustrates a ride vehicle 210 having a central console 270. The consol has various buttons, actuators, monitors and the like thereon which may be actuated by ride participants to control/operated the various interactive effects 235–237 disposed throughout the interactive dark ride 200. The consol may have an RF antenna (internal or external) or the like thereon for transmitting and/or receiving the RF signals 275. These signals allow the vehicle/riders to communicate information to/from the various interactive effects described above and to/from other riders/vehicles. Preferably, the consol and the operating software is configured such that cooperation is required among the ride participants in the vehicle in order to successfully operate the consol and the associated interactive effects. For example, the console may instruct rider #1 to push the red and green buttons while rider #6 is instructed to simultaneously hold down a toggle switch. If the riders cooperate and complete their task in time then the associated effect is successful. If not, then the effect fails and/or is diminished in some perceptible way.

Of course, those skilled in the art will appreciate that the console 270 need not be a physical part of the vehicle 210, as illustrated, but may be embodied in one or more separate control units operable by the ride participants. Alternatively and/or in addition, a "magic" wand interface may be provided (see FIGS. 7A–C) for use within the interactive dark ride 200, 200'. The wand(s) may provide an interface for communicating with the console and/or the wand(s) may themselves provide the same or similar functionality to the console 270 and thereby allow ride participants to directly "magically" interact with their surrounding ride environment by, for example, pointing or using their wands in a particular manner to achieve desired goals or produce desired effects within the ride environment.

The following is a description of one preferred embodiment of one such "magic" wand device and associated communications protocols for use within an interactive dark ride in accordance with the present invention. However, those skilled in the art will recognize that the technology embodied in the wand and its functionality could just as easily be embodied in any other object, either separate from and/or associated with each ride vehicle, including associated game panels, hand-held game units, voice recognition units, communication devices, and the like. Alternatively, those skilled in the art will recognize that some or all of the technology and functionality embodied in the wand device described herein could also be embodied in the center console 270.

Figure 7C:
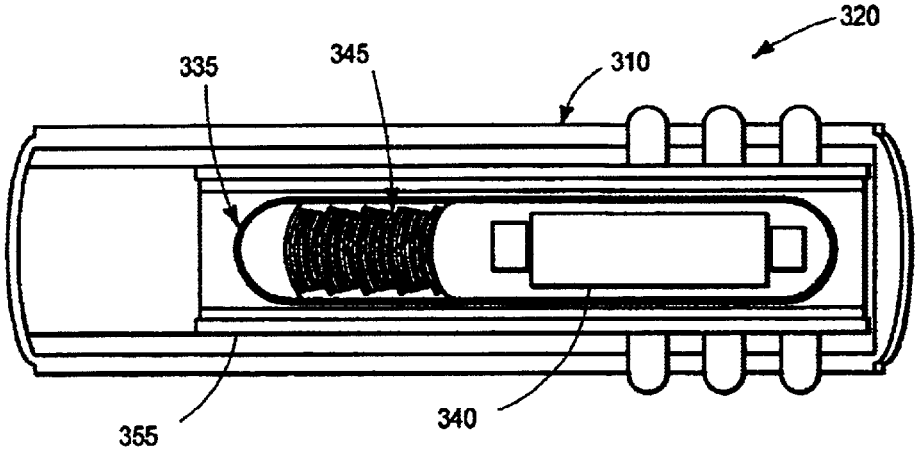
FIG. 7C is a partial cross-section detail view of the distal end or transmitting portion of the wand device of FIG. 2A, illustrating the provision of an RF transponder device therein.
Figure 7A:
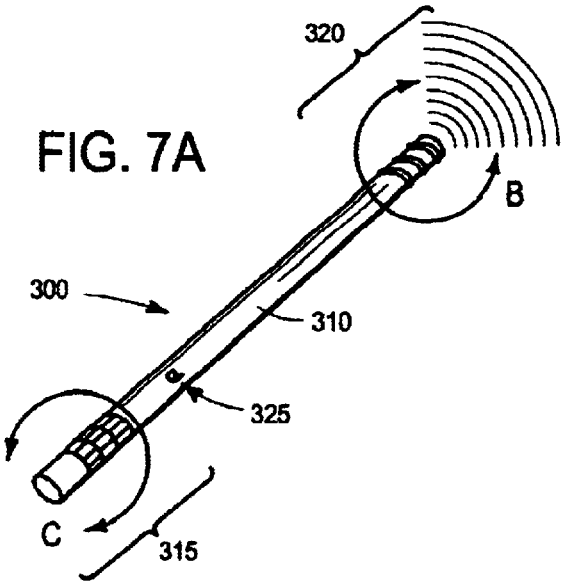
FIG. 7A is a perspective view of a wand device for use within the interactive dark ride of FIG. 2 having features and advantages in accordance with the present invention.

As illustrated in FIG. 7A, the wand 300 may comprise a simple rod-shaped pipe or tube 310 having a proximal end or handle portion 315 and a distal end or transmitting portion 320. If desired, an internal cavity may be provided to receive one or more batteries to power optional lighting, laser or sound effects and/or to power longer-range transmissions such as via an infrared LED transmitter device or RF transmitter device. An optional button 325 may also be provided, if desired, to enable particular desired functions, such as sound or lighting effects or longer-range transmissions.

Use of the wand 300 may be as simple as touching it to a particular surface or "magical" item within the ride 200, 200' or it may be as complex as shaking or twisting the wand a predetermined number of times in a particular manner and/or pointing it accurately at a certain target desired to be "magically" transformed or otherwise affected. As ride participants play and interact within the ride environment (and pre-ride training centers) they learn more about the "magical" powers possessed by the wand 300 and become more adept at using the wand to achieve desired goals or desired play effects. Optionally, ride participants may collect points or earn additional magic levels or ranks for each interactive ride effect or task their team successfully achieves. In this manner, ride participants 225 may compete with one another to see who can score more points and/or achieve the highest magic level.

Figure 7B:
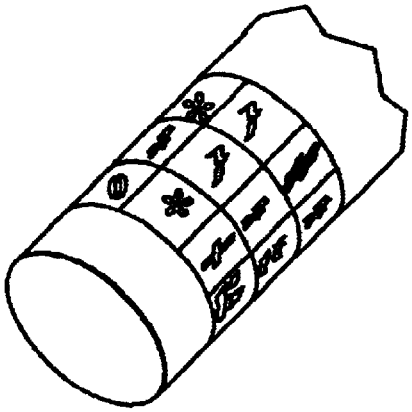
FIG. 7B is a partially exploded detail view of the proximal end or handle portion of the wand device of FIG. 7A, illustrating the optional provision of combination wheels having features and advantages in accordance with the present invention.

FIG. 7B is a partially exploded detail view of the proximal end 315 of the magic wand device 300 of FIG. 7A. As illustrated, the handle portion 315 is fitted with optional combination wheels having various symbols and/or images thereon. Preferably, certain wand functions may require that these wheels be rotated to produce a predetermined pattern of symbols such as three owls, or an owl, a broom and a moon symbol. Those skilled in the art will readily appreciate that the combination wheels may be configured to actuate electrical contacts and/or other circuitry within the wand 300 in order to provide the desired functionality. Alternatively, the combinations wheels may provide a simple security measure to prevent unauthorized users from actuating the wand.

FIG. 7C is a partial cross-section detail view of the distal end of magic wand device 300 of FIG. 7A. As illustrated, the distal end 320 is fitted with an RFID (radio frequency identification device) transponder 335 that is operable to provide relatively short-range RF communications (<60 cm) with one or more receivers or transceivers 308 associated with a particular interactive effect 235–237, ride console 270 and/or another ride vehicle.

At its most basic level, RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either uni-directionally (read only) or, more preferably, bi-directionally (read/write). One suitable RFID transponder is the 134.2 kHz/123.2 kHz, 23 mm Glass Transponder available from Texas Instruments, Inc. (http://www.tiris.com, Product No. RI-TRP-WRHP). This transponder basically comprises a passive (non-battery-operated) RF transmitter/receiver chip 340 and an antenna 345 provided within an hermetically sealed vial 350. A protective silicon sheathing 355 is preferably inserted around the sealed vial 350 between the vial and the inner wall of the tube 310 to insulate the transponder from shock and vibration.

Figure 8:
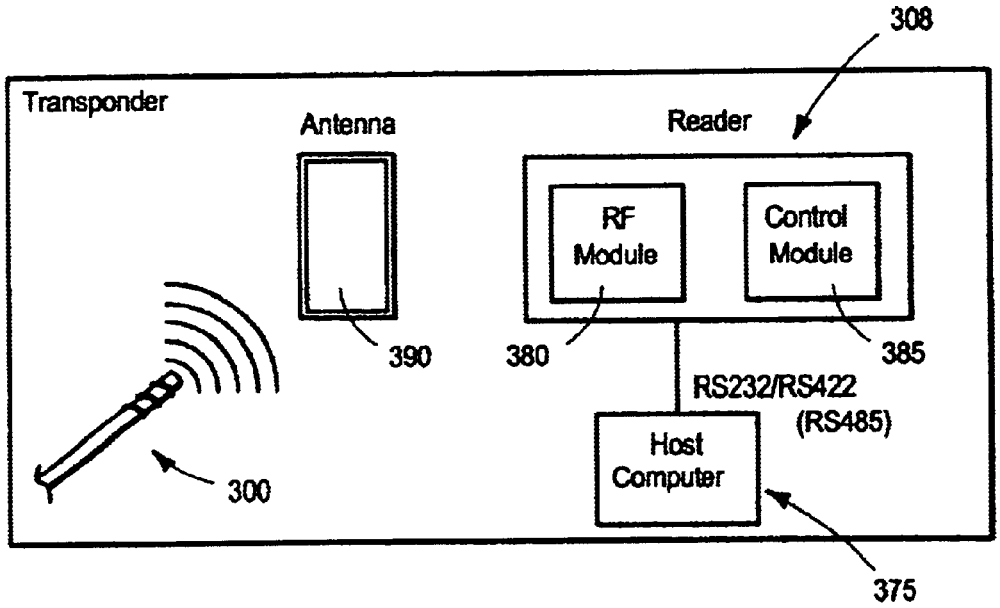
FIG. 8 is a simplified schematic diagram of an RF reader and master control system for use with the wand device of FIG. 7A having features and advantages in accordance with the present invention.

FIG. 8 is a simplified schematic diagram of one embodiment of an RF transceiver 308 and optional master control system 375 for use with the interactive dark ride 200, 200' and/or the various interactive effects embodied therein. As illustrated, the transceiver 308 basically comprises an RF Module 380, a Control Module 385 and an antenna 390. When the distal end of wand 300 comes within a predetermined range of antenna 390 (~20–60 cm) the transponder antenna 345 (FIG. 2C) becomes excited and impresses a voltage upon the RF transmitter/receiver chip 340 disposed within transponder 335 at the distal end of the wand 300. In response, the RF transmitter/receiver chip 340 causes transponder antenna 345 to broadcast certain information stored within the transponder 335 comprising approximately 80 bits of read/write memory. This information typically includes the users unique ID number, magic level or rank and/or certain other information pertinent to the user or the user's ride experiences.

This information is initially received by RF Module 380, which can then transfer the information through standard interfaces to an optional Host Computer 375, Control Module 385, printer, or programmable logic controller for storage or action. If appropriate, Control Module 385 provides certain outputs to activate or control the various associated interactive effects, such as lighting, sound, various mechanical or pneumatic actuators or the like. Optional Host Computer 375 processes the information and/or communicates it to other transceivers 308, as may be required by the ride sequence. If suitably configured, RF Module 380 may also broadcast or "write" certain information back to the transponder 335 to change or update one of more of the 80 read/write bits in its memory. This exchange of communications occurs very rapidly ~70 ms) and so from the user's perspective it appears to be instantaneous. Thus, the wand 300 may be used in this "short range" or "passive" mode to actuate various "magical" effects throughout the ride 200, 200' by simply touching or bringing the tip of the wand 300 into relatively close proximity with a particular transceiver 300 disposed in the consol 270 and/or along the ride path. To provide added mystery and fun, certain transceivers 308 may be hidden within the ride environment so that they must be discovered by continually probing around the surrounding areas (including cue areas, if desired) using the wand 300. The locations of the hidden transceivers may be changed from time to time to keep the game fresh and exciting.

If desired, the wand 300 may also be configured for long range communications with one or more of the transceivers 308 (or other receivers) disposed within the ride environment. For example, one or more transceivers 308 may be located on a roof or ceiling surface, on an inaccessible theming element, or other area out of reach of ride participants. Such long-rage wand operation may be readily achieved using an auxiliary battery powered RF transponder, such as available from Axcess, Inc., Dallas, Tex. If line of sight or directional actuation is desired, a battery-operated infrared LED transmitter and receiver of the type employed in television remote control may be used, as those skilled in the art will readily appreciate. Of course, a wide variety of other wireless communications devices, as well as various sound and lighting effects may also be provided, as desired. Any one or more of these may be actuated via button 325, as desirable or convenient.

Additional optional circuitry and/or position sensors may be added, if desired, to allow the "magic wand" 300 to be operated by waiving, shaking, stroking and/or tapping it in a particular manner. If provided, these operational aspects would need to be learned by play participants as they train in the various play environments. The ultimate goal, of course, is to become a "grand wizard" or master of the wand. This means that the play participant has learned and mastered every aspect of operating the wand to produce desired effects within each play environment. Of course, additional effects and operational nuances can (and preferably are) always added in order to keep the interactive experience fresh and continually changing. Optionally, the wand 300 may be configured such that it is able to display 50 or more characters on a LTD or LCD screen. The wand may also be configured to respond to other signals, such as light, sound, or voice commands as will be readily apparent to those skilled in the art.

Again, any or all of the above features and functions of magical wand 300 may also be embodied by and/or incorporated into the central consol 270 and/or an associated gaming panel, as may be desired.

RFID Tracking Card/Badge

Figure 9A:
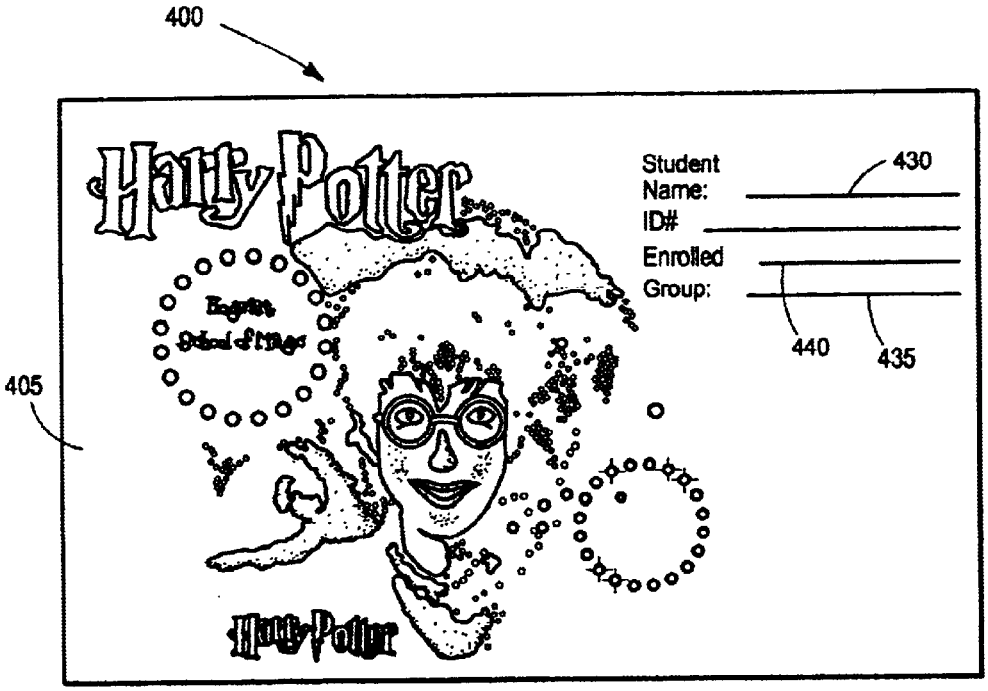
FIGS. 9A and 9B are front and rear views, respectively, of an optional RFID tracking badge or card for use within the interactive dark ride of FIG. 2 having features and advantages in accordance with the present invention.
Figure 9B:
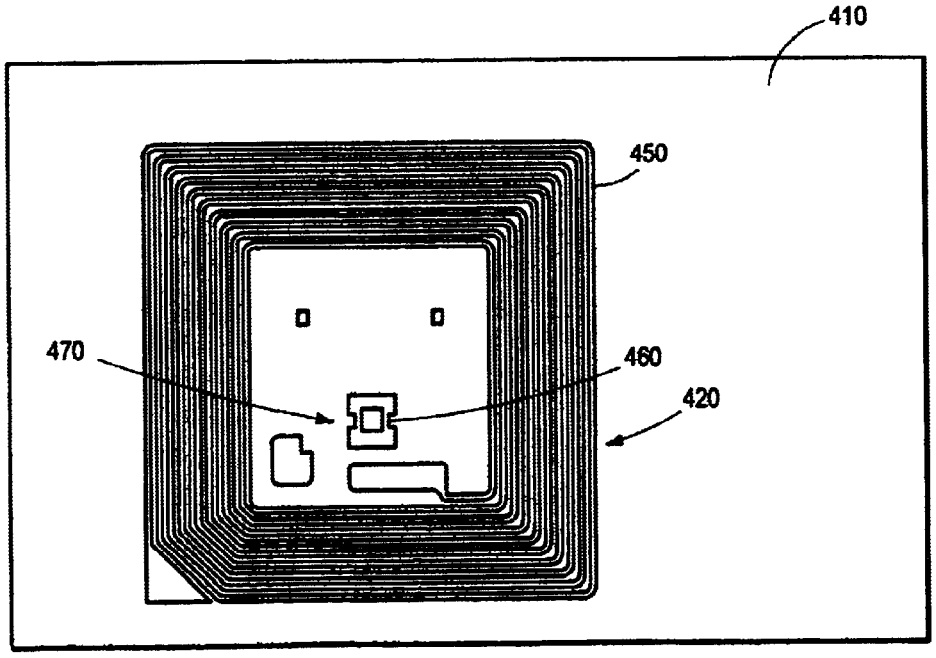

FIGS. 9A and 9B are front and rear views, respectively, of an optional or alternative RFID tracking badge or card 400 for use within the interactive ride 200, 200' described hereinabove. This may be used instead of or in addition to the wand 200, described above. The particular badge 400 illustrated is intended to be affixed or adhered to the front of a shirt or blouse worn by a ride participant during their visit to suitably equipped interactive dark ride. The badge preferably comprises a paper, cardboard or plastic substrate having a front side 404 and a back side 410. The front 405 of each card/badge 400 may be imprinted with graphics, photos, or any other information desired. In the particular embodiment illustrated, the front 405 contains an image of Harry Potter in keeping with the overall theme of the "Wizard's Challenge" interactive dark ride as illustrated and described in conjunction with FIGS. 4A–B. In addition, the front 405 of the badge 400 may include any number of other designs or information pertinent to its application. For example, the ride patron's name 430, and group/team 435 may be indicated for convenient reference. A unique tag ID Number 440 may also be displayed for convenient reference and is particularly preferred where the badge 400 is to be reused by other ride participants.

The obverse side 410 of the badge 400 contains the badge electronics comprising a radio frequency tag 420 preprogrammed with a unique person identifier number ("UPIN"). The tag 420 generally comprises a spiral wound antenna 450, a radio frequency transmitter chip 460 and various electrical leads and terminals 470 connecting the chip 460 to the antenna. This may be a passive tag or battery-powered, as expedience and costs dictate. Advantageously, the UPIN may be used to identify and track individual ride participants within the ride facility. Optionally, each tag 420 may also include a unique group identifier number ("UGIN") which may be used to match a defined group of individuals having a predetermined relationship—either pre-existing or contrived for purposes of game play (e.g. riding in the same ride vehicle 210). If desired, the tag 420 may be covered with an adhesive paper label (not shown) or, alternatively, may be molded directly into a plastic sheet substrate comprising the card 400.

Various readers distributed throughout the ride 200, 200' and surrounding ride facility are able to read the RFID tags 420. Thus, the UPIN and UGIN information can be conveniently read and provided to an associated master control system, display system or other tracking, recording or display device for purposes of creating a record of each play participant's experience within the ride facility. This information may be used for purposes of calculating individual or team scores, tracking and/or locating lost children, verifying whether or not a child is inside a facility, photo capture & retrieval, and/or many other useful purposes as will be readily obvious and apparent to those skilled in the art.

Preferably, the tag 420 is passive (requires no batteries) so that it is inexpensive to purchase and maintain. Such tags and various associated readers and other accessories are commercially available in a wide variety of configurations, sizes and read ranges. RFID tags having a read range of between about 10 cm to about 100 cm are particularly preferred, although shorter or longer read ranges may also be acceptable. The particular tag illustrated is the 13.56 mHz tag sold under the brand name Taggit™ available from Texas Instruments, Inc. (http://www.tiris.com, Product No. RI-103-110A). The tag 420 has a useful read/write range of about 25 cm and contains 256-bits of on-board memory arranged in 8×32-bit blocks which may be programmed (written) and read by a suitably configured read/write device. Such tag device is useful for storing and retrieving desired user-specific information such as UPIN, UGIN, first and/or last name, age, rank or level, total points accumulated, tasks completed, facilities visited, etc. If a longer read/write range and/or more memory is desired, optional battery-powered tags may be used instead, such as available from ACXESS, Inc. and/or various other vendors known to those skilled in the art.

Figure 10A:
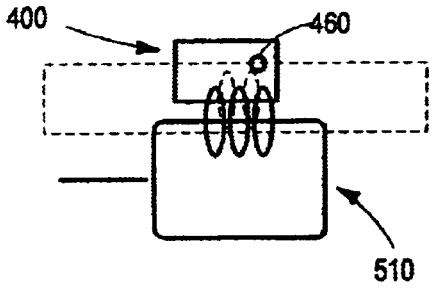
FIGS. 10A and 10B are schematic diagrams illustrating typical operation of the RFID tracking badge of FIG. 9.
Figure 10B:
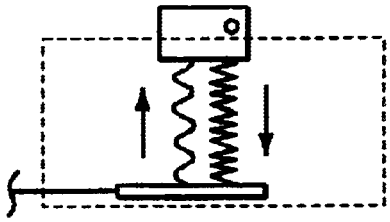
Figure 11:
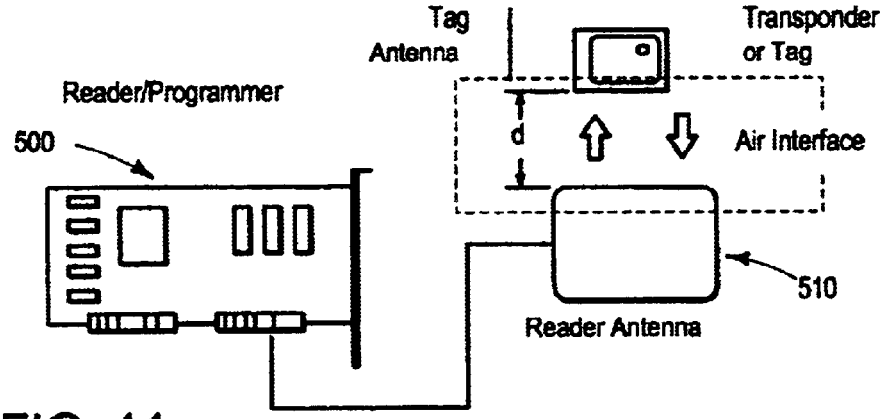
FIG. 11 is simplified schematic diagram of an RFID read/write system for use with the RFID tracking badge of FIG. 9 having features and advantages in accordance with the present invention.

FIGS. 10 and 11 are simplified schematic illustrations of tag and reader operation. The tag 420 is initially activated by a radio frequency signal broadcast by an antenna 510 of an adjacent reader or activation device 500. The signal impresses a voltage upon the antenna 450 by inductive coupling which is then used to power the chip 460 (see, e.g., FIG. 5A). When activated, the chip 460 transmits via radio frequency a unique identification number preferably corresponding to the UPIN and/or UGIN described above (see, e.g., FIG. 5B). The signal may be transmitted either by inductive coupling or, more preferably, by propagation coupling over a distance "d" determined by the range of the tag/reader combination. This signal is then received and processed by the associated reader 500 as described above. If desired, the RFID card or badge 400 may also be configured for read/write communications with an associated reader/writer. Thus, the unique tag identifier number (UPIN or UGIN) can be changed or other information may be added.

As indicated above, communication of data between a tag and a reader is by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care should be taken in the placement and orientation of the various readers 500 so as to minimize the probability of such data transmission errors. Preferably, the readers are placed at least 30–60 cm away from any metal objects, power lines or other potential interference sources. Those skilled in the art will also recognize that the write range of the tag/reader combination is typically somewhat less (~10–15% less) than the read range "d" and, thus, this should also be taken into account in determining optimal placement and positioning of each reader device 500.

Typical RFID data communication is asynchronous or unsynchronized in nature and, thus, particular attention should be given in considering the form in which the data is to be communicated. Structuring the bit stream to accommodate these needs, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are well know to those skilled in the art and will not be further discussed herein. The choice of carrier wave frequency is also important in determining data transfer rates. Generally speaking the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular game application.

Figure 12:
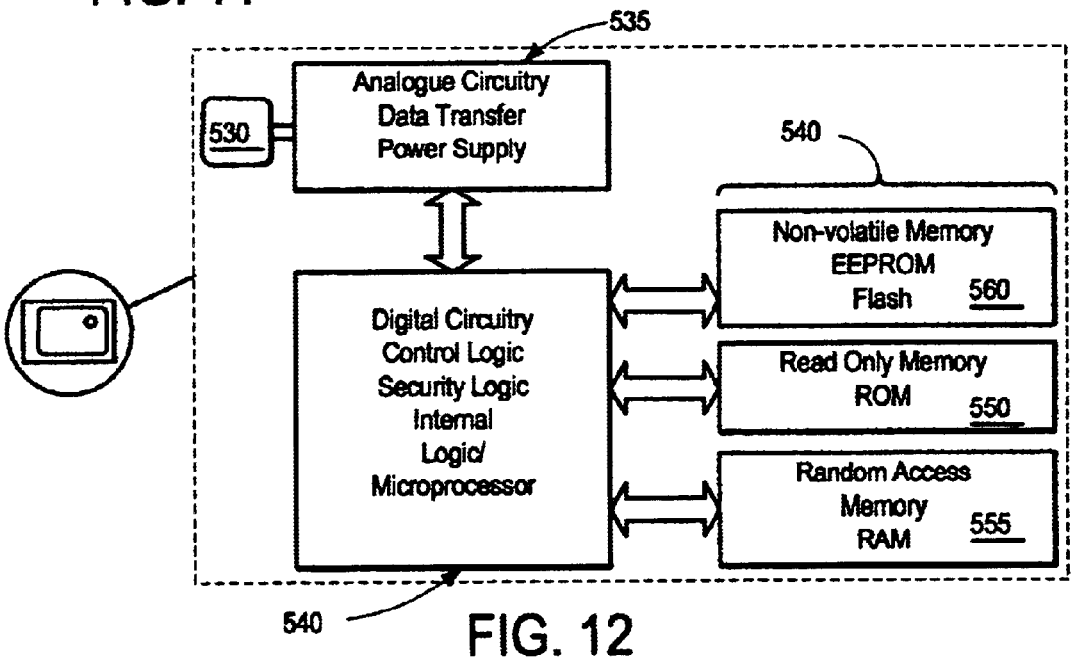
FIG. 12 is a simplified block diagram illustrating the basic organization and function of the electronic circuitry comprising the RFID tag device of FIG. 9B.

FIG. 12 is a simplified block diagram illustrating the basic organization and function of the electronic circuitry comprising the radio frequency transmitter chip 460 of the RFID tag device 420 of FIG. 4B. The chip 460 basically comprises a central processor 530, Analogue Circuitry 535, Digital Circuitry 540 and on-board memory 545. On-board memory 545 is divided into read-only memory (ROM) 550, random access memory (RAM) 555 and non-volatile programmable memory 560, which is available for data storage. The ROM-based memory 550 is used to accommodate security data and the tag operating system instructions which, in conjunction with the processor 530 and processing logic deals with the internal "house-keeping" functions such as response delay timing, data flow control and power supply switching. The RAM-based memory 555 is used to facilitate temporary data storage during transponder interrogation and response. The non-volatile programmable memory 560 may take various forms, electrically erasable programmable read only memory (EEPROM) being typical. It is used to store the transponder data and is preferably non-volatile to ensure that the data is retained when the device is in its quiescent or power-saving "sleep" state.

Various data buffers or further memory components (not shown), may be provided to temporarily hold incoming data following demodulation and outgoing data for modulation and interface with the transponder antenna 450. Analog Circuitry 535 provides the facility to direct and accommodate the interrogation field energy for powering purposes in passive transponders and triggering of the transponder response. Analog Circuitry also provides the facility to accept the programming or "write" data modulated signal and to perform the necessary demodulation and data transfer processes. Digital Circuitry 540 provides certain control logic, security logic and internal microprocessor logic required to operate central processor 530.

Master Control System

Depending upon the degree of complexity desired and the amount of information sharing required, the transceivers 308 may or may not be connected to a master control system or central server 375 (FIG. 8). If a master system is utilized, preferably each wand 300 and/or RFID card 400 is configured to electronically send and receive information to and from various receivers or transceivers 308 distributed throughout the ride facility using a send receive radio frequency ("SRRF") communication protocol. This communications protocol provides the basic foundation for a complex, interactive entertainment system which creates a seemingly magic interactive play experience for ride participants who possess and learn to use the magical wand. In its most refined embodiments, a user may electronically send and receive information to and from other wands and/or to and from a master control system located within and/or associated with any of a number of ride environments and/or other play environments. This network of SRRF-compatible ride and entertainment environments provides a complex, interactive play and entertainment system that creates a seamless magical interactive experience that transcends conventional physical and temporal boundaries.

SRRF may generally be described as an RF-based communications technology and protocol that allows pertinent information and messages to be sent and received to and from two or more SRRF compatible devices or systems. While the specific embodiments descried herein are specific to RF-based communication systems, those skilled in the art will readily appreciate that the broader interactive play concepts taught herein may be realized using any number of commercially available 2-way and/or 1-way medium range wireless communication devices and communication protocols such as, without limitation, infrared-, digital-, analog, AM/FM-, laser-, visual-, audio-, and/or ultrasonic-based systems, as desired or expedient.

The SRRF system can preferably send and receive signals (up to 40 feet) between tokens and fixed transceivers. The system is preferably able to associate a token with a particular zone as defined by a token activation area approximately 10–15 feet in diameter. Different transceiver and antenna configurations can be utilized depending on the SRRF requirements for each play station. The SRRF facility tokens and transceivers are networked throughout the facility. These devices can be hidden in or integrated into the facility's infrastructure, such as walls, floors, ceilings and ride effects, etc. Therefore, the size and packaging of these transceivers is not particularly critical.

In a preferred embodiment, the entire interactive dark ride 200' and surrounding facility is configured with SRRF technology to provide a master control system for an interactive entertainment play environment using SRRF-compatible magic wands and/or tracking devices. A typical ride/entertainment facility provided with SRRF technology may allow 300–400 or more users to more-or-less simultaneously send and receive electronic transmissions to and from the master control system using a magic wand or other SRRF-compatible tracking device.

In particular, the SRRF system uses a software program and data-base that can track the locations and activities of up to a hundred more users. This information is then used to adjust the play/ride experience for the user based on "knowing" where the user/player has been, what objectives that player (or group of players in a ride vehicle) has accomplished and how many points or levels have been reached. The system can then send messages to the users/vehicles throughout the ride experience. For example, the system can allow or deny access to a vehicle 210 into a secret passage based on how many points or levels reached by that riders on the vehicle and/or based on what objectives the riders have accomplished or helped accomplish. It can also indicate, via sending a message to the user the amount of points or specific objectives necessary to complete a "mission" or enter the next level of play. The master control system can also preferably send messages to the user from other users.

The system is preferably sophisticated enough that it can allow multiple users to interact with each other adjusting the ride/game instantly. The master system can also preferably interface with digital imaging and/or video capture so that the users/riders can be visually tracked. Any user/rider can locate another user/rider either through the video capturing system or by sending a message to another device. At the end of a visit, ride patrons are informed of their activities and the system interfaces with printout capabilities. The SRRF system is preferably capable of sending and receiving signals up to 100 feet. Transmitter devices can also be hidden in walls or other structures in order to provide additional interactivity and excitement for play participants.

Suitable embodiments of the SRRF technology described above may be obtained from a number of suitable sources, such as AXCESS, Inc. and, in particular, the AXCESS active RFID network system for asset and people tacking applications. In another preferred embodiment the system comprises a network of transceivers 308 installed at specific points throughout a facility. Ride participants are outfitted or provided with a reusable "token"—a standard AXCESS personnel tag clipped to their clothing in the upper chest area. As each ride patron enters a specific interactive ride or other "game zone" within the facility, the player's token receives a low frequency activation signal containing a zone identification number (ZID). The token then responds to this signal by transmitting both its unique token identification number (TID) along with the ZID, thus identifying and associating the participant with a particular zone.

The token's transmitted signal is received by a transceiver 308 attached to a data network built into the facility. Using the data network, the transceiver forwards the TID/ZID data to a host computer system. The host system uses the SRRF information to log/track the guest's progress through the facility while interfacing with other interactive systems within the venue. For example, upon receipt of a TID/ZID message received from Zone 1, the host system may trigger a digital camera focused on that area, thus capturing a digital image of the player which can now be associated with both their TID and the ZID at a specific time. In this manner the SRRF technology allows the master control system to uniquely identify and track people as they interact with various games and activities in a semi-controlled play environment. Optionally, the system may be configured for two-way messaging to enable more complex interactive gaming concepts.

Theming/Storyline

The present invention may be carried out using a wide variety of suitable themed environments, storylines and characters, as will be readily apparent to those skilled in the art. The following specific example is provided for purposes of illustration and for better understanding of the invention and should not be taken as limiting the invention in any way:

EXAMPLE

The greatest talents in the world get together and design a living, breathing, artificially intelligent transport vehicle (e.g., could be vehicle with android driver) that can travel from the real world into a fantasy land, parallel universe, another time, another dimension, or the like. The main characters need your help to rescue their friends from evil. You (rider) are asked to volunteer to travel in a specially designed vehicle into their world and help save their friends.

Each vehicle is equipped to take a team of volunteers into their favorite fantasy, however it isn't an easy task. Not everyone will make it into the fantasy world. It depends on the training and skill of the volunteers on whether they make it to the end of the journey to the fantasyland. Each vehicle has its own unique personality and lifeline (Human-like android vehicle). Volunteers need to be trained and then operate the vehicle as a team. They only have 6 minutes to successfully maneuver it through numerous challenges, forces of evil and catastrophes, all of which could cause damage to this almost human vehicle. If the vehicle makes it through the journey to the fantasy world with minimal damage it will be reliable enough to enter the fantasy world. If it takes on too much damage, it will need to go to the repair dock and returned home.

Each vehicle requires a group of 2–16 people to maneuver it safely. First volunteers are teamed, decontaminated, given gear, trained and finally shrunken to the size of to toothpick in order to fit into the vehicle. This is the initial ride sequence that is done prior to sitting in the vehicle. Since volunteers can only withstand being shrunken for 6–7 minutes their time is limited in getting to the fantasy world. The journey to the fantasy world is riddled with obstacles, and evil forces trying to keep you from entering the fantasy world. (License characters good/bad come into this. The volunteers will have a mission to save, help or meet their favorite character. The evil forces will try to prevent this from happening.) Some of the possible challenges will be wear-and-tear from entering zones (launch, fastfoward, landing/impact) fire balls, electrical breakdowns, ice storms, tornado spins, crack in the vehicle, casted spells, fuel loss, mud slides, deep water emersion, fire/water breathing dragons, etc. Even humorous encounters like landing in oversized apple pies, being flushed in a toilet could be the challenge.

The ride sequence begins in the cue area. A pre-show area is provided where guests feel as though they are lining up to "volunteer" for the fantasy adventure. Certain characters from the storyline call to the guests thanking them for signing up to volunteer for this important adventure. A new way of multi-line queuing is used to help create a teaming atmosphere while telling the story. The pre-show has two general purposes: (1) it tells the basic storyline by preparing riders for the event to come/introducing them to the possible vehicles (androids) they may be riding in; (2) it also gets people talking, laughing and teaming with each other. While in the queue line, guests are able to make certain choices in the way they would like to experience the ride. In essence ride patrons choose their "character type" and needed skill level (captain, driver, repair, fighter, do-nothinger). This way when the guests get to training stations (described later) they have already selected a line of specialty before getting into the vehicle.

Throughout the queue various interactive stations and overall challenges are presented to the guests. This further encourages grouping, socializing, interaction among the people in the queue. Families talk to each other and decide to team up, third time riders, older kids and teens are desired by newer less experienced riders to help lead their team. The staff next staff counts-out the team of 12–16 who are already standing in a queue that indicated how they want to experience the ride. They are then taken to the first "training" pod. This is the point that the riders enter the vehicle building. Various training pods are provided within the building. The pods are small rooms with opening and closing "elevator" type doors. Each room/pod holds 12–16 people and is thematically designed consistent with the ride. Each pod displays a simple show on monitors. These may include gags, special effects and various audio tracks. Within the training pods, guests are shown how to operate the vehicle by testing out mock stations. Humorous presentation and scores are shown on how they did.

Once all training is completed, the team is given whatever tools they may need to complete their journey: 3D glasses, RFID cards, wands, etc. Guests are then funneled into their ride vehicle. The vehicle introduces itself to the riders as their "personal escort". Each rider is seated at their specific function station and given a quick, comic introduction to their android vehicle and the tasks ahead. Various gags (vibrating seats, squirt water, jokes, etc.) may be used at this point to get riders to focus attention on each other and the vehicle. The experiences are programmed into the ride to encourage riders follow the command and comic interactions of their vehicle. The vehicle will follow the same ride path as its "neighbors" but the comic style and overall voice/personality of each vehicle is different from vehicle to vehicle. This ensures that the experience will be new and fresh at least in this entertainment aspect even for riders who have participated multiple times.

The vehicle then follows a track or path which takes the vehicle through 3–6 stations. These stations/large-enclosed rooms have three-dimensional theming, special effects; projection screens for 3d film and/or other lighting and audio systems/effects. Essentially the vehicle would travel from room to room, with doors closing and opening to establish a contained dark-ride experience. Once the vehicle is in the enclosed room audio, lights, special effects, 3d filming and interactive gaming commence. When the vehicle is traveling from station to station, the "show" continues but is within the vehicle rather than in the room (the vehicle is programmed to entertain guests from within the vehicle). Outside the ride may be themed or pitch dark, as desired.

At the end of the ride sequence a final interactive effect is provided. Those who were successful in maneuvering their vehicle and had little damage to their vehicle will experience one effect ("the fantasy sequence"). Those who are not successful in their mission will experience ("the repair sequence"). Each sequence may be equally fun, just different. Thus, the ride has a different ending depending upon how the riders performed during the ride sequence.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive amusement ride comprising two or more multi-passenger ride vehicles sized, configured and adapted to carry groups of ride participants along a defined ride path through two or more light-controlled rooms, at least one of said ride vehicles being configured with an on-board interactive effects console operable by one or more of said ride participants, said interactive ettects console being disposed on-board ot said at least one ride vehicle generally within operable communications range and/or within reaching range of said one or more ride participants while riding said at least one ride vehicle, and wherein said at least one ride vehicle further comprises two or more occupant seats for safely seating a corresponding number of ride participants, said two or more occupant seats being oriented relative to said at least one ride vehicle and to each other occupant seat such that ride participants riding on said at least one ride vehicle generally face inward of the ride vehicle generally facing one another, and wherein said interactive effects console in said at least one ride vehicle is configured and adapted to selectably produce at least one on-board vehicle effect or console effect in response to an operating input from either: (i) one or more of said ride participants riding said at least one ride vehicle, (ii) one or more ride participants riding in a different ride vehicle, and/or (iii) one or more bystanders observing said at least one ride vehicle and/or waiting in line to ride said interactive amusement ride.

2. The interactive amusement ride of claim 1 wherein each said ride vehicle is sized and adapted to carry 4 to 8 ride participants with occupant seating being generally arranged concentrically about a center console comprising said interactive effects console.

3. The interactive amusement ride of claim 2 wherein said center console comprises one or more controls, buttons and/or other actuator devices that enable one or more of said ride participants, individually or working in cooperation, to control or actuate one or more interactive effects located on or in said ride vehicle and/or located along the ride vehicle path.

4. The interactive amusement ride of claim 2 wherein said at least one on-board vehicle effect or console effect comprises one or more of the following; shocking, pulsing, heaving, poking, sneezing, coughing, braking, flat tire, fix a flat tire, floating, flatulence, burping, increase/decrease life force, increase/decrease fuel, play a song, play a video, play a hologram, play a game.

5. The interactive amusement ride of claim 1 wherein said interactive effects console comprises an on-board wireless receiver or transceiver, capable of receiving wireless input command signals from one or more associated transmitter devices.

6. The interactive amusement ride of claim 5 wherein at least one of said one or more associated transmitter devices comprises one or more of the following: RFID tag, infrared light (IR) transmitter, laser transmitter, micro-wave transmitter, UHF transmitter, VHF transmitter, ultra-sonic transmitter, magnetic field transmitter.

7. The interactive amusement ride of claim 5 wherein at least one of said one or more associated transmitter devices comprises a motion activated wand device.

8. The interactive amusement ride of claim 7 wherein said wand is configured and adapted to enable ride participants to wirelessly trigger various desired effects associated with each said ride vehicle and/or effects arranged a long said ride vehicle path by holding and/or moving the wand in a particular predetermined manner.

9. An interactive amusement ride comprising one or more ride vehicles sized, configured and adapted to carry one or more ride participants along a defined ride path through two or more rooms having various themed visual and special effects therein, at least one of said ride vehicles being configured with an on-board interactive effects interface including at least one wireless receiver and/or transceiver, said on-board interactive effects interface being disposed on-board of said at least one ride vehicle generally within operable communications range and/or within reach of said one or more ride participants while riding said at least one ride vehicle, and wherein said interactive effects interface is configured and adapted to selectably trigger or control at least one vehicle function or on-board effect in response to one or more wireless input devices operated by either: (i) one or more of said ride participants riding said at least one ride vehicle, (ii) one or more ride participants riding in a different ride vehicle, and/or (iii) one or more bystanders observing said at least one ride vehicle and/or waiting in line to ride said interactive amusement ride.

10. The interactive amusement ride of claim 9 wherein each said ride vehicle is sized and adapted to carry 4 to 8 ride participants with occupant seating being generally arranged concentrically about a center console comprising said interactive effects interface.

11. The interactive amusement ride of claim 10 wherein said center console comprises one or more controls, buttons and/or other actuator devices that enable one or more of said ride participants, individually or working in cooperation, to control or actuate one or more interactive effects located on or in said ride vehicle and/or located along the ride vehicle path.

12. The interactive amusement ride of claim 9 wherein said interactive effects interface comprises an on-board wireless radio-frequency receiver or transceiver capable of receiving wireless input command signals from said one or more wireless input devices.

13. The interactive amusement ride of claim 12 wherein at least one of said one or more wireless input devices comprises one or more of the following: RFID tag, infrared light (IR) transmitter, laser transmitter, micro-wave transmitter, UHF transmitter, VHF transmitter, ultra-sonic transmitter, magnetic field transmitter.

14. The interactive amusement ride of claim 9 wherein at least one of said one or more wireless input devices comprises a motion-activated wand.

15. The interactive amusement ride of claim 14 wherein said wand is configured and adapted to enable ride participants to wirelessly trigger various desired effects associated with each said ride vehicle and/or effects arranged along said ride vehicle path by holding, waiving and/or shaking the wand in a particular learned manner.

16. The interactive amusement ride of claim 9 wherein each said ride vehicle has a unique or semi-unique electronic personality comprising a plurality of on-board voice or sound effects selectively or randomly triggered or sequenced as part of the interactive ride experience.

17. A method for amusing one or more ride participants riding on an interactive dark ride, comprising the following steps:

seating said ride participants in a movable ride vehicle in a generally inwardly facing circle so that each ride participant can see and communicate with each other ride participant;

directing said ride vehicle along a generally predetermined path of travel through one or more light-controlled rooms;

within each said light-controlled rooms presenting said ride participants with one or more visual, aural and/or other sensory effects selected to convey or elicit a particular desired ride theme or storyline;

within said ride vehicle simultaneously presenting said ride participants with one or more on-board visual, aural and/or other sensory effects selected to convey or elicit said desired theme or storyline; and providing at least one ride participant-operated interactive effects interface and enabling said ride participants to play a game on-board of said ride vehicle and/or to selectively activate or control one or more of said on-board visual, aural or sensory effects using said ride participant-operated interactive effects interface.

18. The method of claim 17 comprising the step of seating 4 to 8 ride participants per vehicle and arranging said ride participants generally concentrically about a center console comprising participant-operated interactive effects interface.

19. The method of claim 18 comprising the further step of providing said center console with one or more controls, buttons and/or other actuator devices and enabling one or more of said ride participants, individually or working in cooperation, to play a game on-board of said ride vehicle and/or to selectively activate or control one or more of said on-board visual, aural or sensory effects using said center console.

20. The method of claim 17 comprising the further step of providing said interactive effects interface with an on-board wireless receiver or transceiver and receiving wireless input command signals from one or more associated transmitter devices and using said input command signals to selectively activate or control one or more of said on-board visual, aural or sensory effects.

21. The method of claim 20 comprising the step of providing each ride participant with a portable wireless transmitter device comprising one or more of the following: RFID tag, infrared light (IR) transmitter, laser transmitter, micro-wave transmitter, UHF transmitter, VHF transmitter, ultra-sonic transmitter, magnetic field transmitter.

22. The method of claim 17 comprising the step of providing each ride vehicle and/or ride participant with at least one wireless transmitter device comprising a motion activated wand device and teaching each said ride participant how to use said motion activate wand device to selectively activate or control one or more of said visual, aural or sensory effects.

23. The method of claim 22 comprising the further step of using said wand device to wirelessly trigger various desired effects associated with each said ride vehicle and/or effects arranged along said ride vehicle path by holding and/or moving the wand in a particular predetermined manner.

24. The method of claim 17 comprising the further step of selectively and/or randomly triggering or sequencing within each ride vehicle one or more of a plurality of stored voice, sound and/or sensory effects for creating in each vehicle a simulated personality or human quality.

25. The method of claim 24 wherein said voice, sound and/or sensory effects comprise one or more of the following: pulsing, heaving, poking, sneezing, coughing, braking, flat tire, fix a flat tire, floating, flatulence, burping, illness, death, injury or pain.

26. An interactive amusement ride comprising one or more ride vehicles sized, configured and adapted to carry one or more ride participants along a defined ride path through an interactive dark ride experience including various themed visual, aural and/or other sensory effects, each vehicle and/or ride participant being equipped with one or more associated motion-activated wands adapted to wirelessly activate or control one or more of said visual, aural or sensory effects simply by waiving or moving said wand in a particular learned motion.

27. The interactive amusement ride of claim 26 wherein each said ride vehicle is sized and adapted to carry 4 to 8 ride participants with occupant seating being generally arranged concentrically about a center console comprising an interactive effects interface.

28. The interactive amusement ride of claim 26 wherein said center console comprises one or more wand-activated input devices for enabling one or more of said ride participants, individually or working in cooperation with one another, to control or actuate one or more of said visual, aural or sensory effects.

29. The interactive amusement ride of claim 28 wherein said interactive effects interface comprises an on-board wireless radio-frequency receiver or transceiver capable of receiving wireless input command signals from said one or more associated motion-activated wands.

30. The interactive amusement ride of claim 27 wherein each said ride vehicle possesses a unique or semi-unique electronic personality or human quality comprising a plurality of on-board voice, sound and/or sensory effects which are selectively and/or randomly triggered or sequenced as part of a desired interactive ride experience.

31. The interactive amusement ride of claim 30 wherein said voice, sound and/or sensory effects comprise one or more of the following: pulsing, heaving, poking, sneezing, coughing, braking, flat tire, fix a flat tire, floating, flatulence, burping, illness, death, injury or pain, vehicle motion, vibration, air blast, lights, fog, tickler, scent, hot/cold, water spritz, sound, shaking, shocking, singing, cursing, grunting.

* * * * *